US010508506B2

(12) United States Patent
Hisdal et al.

(10) Patent No.: US 10,508,506 B2
(45) Date of Patent: Dec. 17, 2019

(54) RISER METHODS AND APPARATUSES

(71) Applicant: CONNECTOR AS, Kokstad (NO)

(72) Inventors: Pal Magne Hisdal, Kokstad (NO); John Hestenes, Kokstad (NO); Andre Kristiansen Midtun, Kokstad (NO); John Olav Myking, Kokstad (NO)

(73) Assignee: CONNECTOR AS, Kokstad (NO)

( * ) Notice: Subject to any disclaimer, the term of this patent is extended or adjusted under 35 U.S.C. 154(b) by 0 days.

(21) Appl. No.: 15/766,117

(22) PCT Filed: Oct. 5, 2016

(86) PCT No.: PCT/EP2016/073778
§ 371 (c)(1),
(2) Date: Apr. 5, 2018

(87) PCT Pub. No.: WO2017/060291
PCT Pub. Date: Apr. 13, 2017

(65) Prior Publication Data

US 2018/0313175 A1 Nov. 1, 2018

(30) Foreign Application Priority Data

Oct. 5, 2015 (GB) ..... 1517554

(51) Int. Cl.
*E21B 19/10* (2006.01)
*E21B 41/04* (2006.01)
(Continued)

(52) U.S. Cl.
CPC ..... *E21B 19/10* (2013.01); *E21B 17/01* (2013.01); *E21B 29/12* (2013.01); *E21B 41/04* (2013.01)

(58) Field of Classification Search
CPC .... E21B 43/013; E21B 43/0135; E21B 19/00; E21B 19/087; E21B 19/12; E21B 19/24;
(Continued)

(56) References Cited

U.S. PATENT DOCUMENTS 1,929,447 A 10/1933 Remde
2,775,469 A * 12/1956 Brown ..... F16L 41/021 285/133.21
(Continued)

FOREIGN PATENT DOCUMENTS

| | | |
|---|---|---|
| GB | 248508 | 3/1926 |
| WO | 2004/090348 | 10/2004 |
| WO | 2013/144601 | 10/2013 |

OTHER PUBLICATIONS

PCT, International Search Report and Written Opinion of the International Searching Authority, International Application No. PCT/EP2016/073778, 17 pages, dated Mar. 21, 2017.
(Continued)

*Primary Examiner* — Matthew R Buck
*Assistant Examiner* — Aaron L Lembo
(74) *Attorney, Agent, or Firm* — Thompson Hine LLP

(57) ABSTRACT

An apparatus including an external surface portion shaped so as to mate with a docking device, and two half-shells having internal surfaces of semi-circular cross section. The apparatus further includes a plurality of segments arranged inside the two half-shells and including teeth for gripping onto a shaft, and an installation tool operable to cause the two half-shells to close around the shaft, thereby securing the apparatus to the shaft.

5 Claims, 31 Drawing Sheets

(51) Int. Cl.
*E21B 17/01* (2006.01)
*E21B 29/12* (2006.01)

(58) Field of Classification Search
CPC ..... E21B 17/01; E21B 17/012; E21B 17/105; E21B 41/0014; E21B 41/04
See application file for complete search history.

(56) References Cited

U.S. PATENT DOCUMENTS 3,724,061 A * 4/1973 Schipper ..... B63B 35/03 137/15.08
4,014,180 A * 3/1977 Kelly ..... F16L 1/26 166/347
4,103,943 A * 8/1978 Curtin ..... F16L 37/138 285/419
4,290,632 A * 9/1981 Manchester, Jr. ..... F16L 21/08 285/15
4,330,143 A * 5/1982 Reneau ..... F16L 1/26 285/15
4,445,804 A * 5/1984 Abdallah ..... F16L 1/166 405/169
4,490,073 A * 12/1984 Lawson ..... E21B 43/0107 166/343
4,643,614 A * 2/1987 Laursen ..... E21B 17/015 166/350
4,832,379 A * 5/1989 Smith ..... F16L 23/0286 285/323
4,848,949 A * 7/1989 Castel ..... E21B 43/013 403/12
4,906,136 A * 3/1990 Norbom ..... E21B 43/0135 405/169
5,590,913 A * 1/1997 Morris ..... F16L 1/26 285/18
6,129,391 A * 10/2000 Rakieski ..... F16L 25/009 285/337
6,694,684 B2 * 2/2004 Radke ..... E04G 15/061 285/4
6,830,268 B2 * 12/2004 Krausz ..... F16L 55/172 138/99
7,086,807 B2 * 8/2006 Mackinnon ..... E21B 41/04 166/347
7,455,478 B2 * 11/2008 Matteucci ..... B23D 57/0084 405/158
7,600,569 B2 * 10/2009 Routeau ..... E21B 43/0135 166/344
8,047,278 B2 * 11/2011 Swietlik ..... E21B 19/08 166/138
8,162,061 B2 * 4/2012 Maxwell ..... E21B 41/0007 166/177.4
8,418,766 B2 * 4/2013 Luppi ..... E21B 43/013 166/345
8,511,387 B2 * 8/2013 Fraser ..... E21B 43/0122 166/338
8,517,634 B1 * 8/2013 Liso ..... F16L 1/26 405/158
8,528,646 B2 * 9/2013 Stezycki ..... E21B 43/0122 166/338
8,540,031 B2 * 9/2013 Rimi ..... E21B 33/035 166/344
9,004,818 B2 4/2015 Laborde et al.
9,080,393 B2 * 7/2015 Wishahy ..... E21B 17/01
9,784,062 B1 * 10/2017 Solis ..... B23D 57/0084
10,260,664 B2 * 4/2019 Richardson ..... F16L 1/26
2004/0120779 A1 * 6/2004 Evans ..... F16L 41/06 408/1 R
2006/0062638 A1 3/2006 Bergeron et al.
2007/0044973 A1 * 3/2007 Fraser ..... E21B 17/01 166/367
2007/0095524 A1 5/2007 Lesko
2007/0140797 A1 6/2007 Armstrong
2008/0205990 A1 * 8/2008 Bird ..... E21B 43/0107 405/184.1
2008/0245933 A1 * 10/2008 Stokes ..... F16B 2/10 248/74.1
2008/0289829 A1 * 11/2008 Bergeron ..... E21B 17/012 166/350
2009/0272855 A1 * 11/2009 Oram ..... E21B 17/012 248/67.5
2009/0290939 A1 * 11/2009 Large ..... B63B 21/502 405/224
2010/0059990 A1 * 3/2010 Avery ..... F16L 37/008 285/197
2010/0186963 A1 * 7/2010 Butcher ..... E21B 43/0107 166/341
2012/0118580 A1 * 5/2012 Swanson ..... E21B 43/0122 166/344
2012/0133122 A1 * 5/2012 Hovik ..... B63B 27/24 285/27
2012/0141212 A1 6/2012 Long
2012/0145407 A1 6/2012 Varley et al.
2012/0199358 A1 * 8/2012 Larsson ..... E21B 43/0107 166/341
2012/0261133 A1 * 10/2012 Stezycki ..... E21B 43/0122 166/363
2015/0176340 A1 * 6/2015 Bastesen ..... F16L 1/26 166/345
2015/0354295 A1 * 12/2015 Routeau ..... E21B 43/0107 166/343
2015/0361770 A1 * 12/2015 Luppi ..... E21B 43/0107 166/343
2016/0039076 A1 * 2/2016 Voss ..... B25B 27/16 29/468
2016/0258552 A1 * 9/2016 Larsson ..... F16L 1/26
2017/0130871 A1 * 5/2017 Bastesen ..... F16L 1/26
2018/0313166 A1 * 11/2018 Nijjar ..... E21B 17/085
2019/0055822 A1 * 2/2019 Cargol, Jr. ..... E21B 19/002

OTHER PUBLICATIONS

GB, Combined Search and Examination Report Under Section s17 and 18(3), GB Application No. 1517554.0, 7 pages, dated May 5, 2016.

* cited by examiner

RISER METHODS AND APPARATUSES

CROSS-REFERENCE TO RELATED APPLICATIONS

This application is a national stage filing of International Application No. PCT/EP2016/073778 (Publication No. WO 2017/060291), filed on Oct. 5, 2016, which claims priority to GB Application 1517554.0, filed on Oct. 5, 2015. The entire contents of both of these applications are incorporated by reference herein.

The present invention relates to risers, and specifically methods of repair thereof and apparatuses used in the repair thereof.

BACKGROUND

There is increasing demand in the oil and gas industry to develop equipment and methods to enable subsea riser repair. Often, the aging risers to be repaired are disposed in deep water, making them inaccessible to divers. Furthermore, increasing restrictions on the use of divers is making riser repair, even in shallow water, increasingly challenging. Thus efforts are being made to develop techniques for deep water riser repair, utilizing apparatuses which can be hydraulically controlled from a remotely operated vehicle (ROV). The techniques must by design also be sensitive to the often fragile nature of the risers, as well as incorporating contingency measures in the event of a failed repair effort.

SUMMARY

In one embodiment, the invention is an apparatus including an external surface portion shaped so as to mate with a docking device, and two half-shells having internal surfaces of semi-circular cross section. The apparatus further includes a plurality of segments arranged inside the two half-shells and including teeth for gripping onto a shaft, and an installation tool operable to cause the two half-shells to close around the shaft, thereby securing the apparatus to the shaft.

BRIEF DESCRIPTION OF THE DRAWINGS

Some embodiments of the invention will now be described by way of example only and with reference to the accompanying drawings, in which.

DETAILED DESCRIPTION

A gripper unit apparatus (GU); alignment, installation and activation (AIA) apparatus; and several methods of use thereof are described in detail below, by way of example, and with reference to the accompanying drawings.

Figure 1:
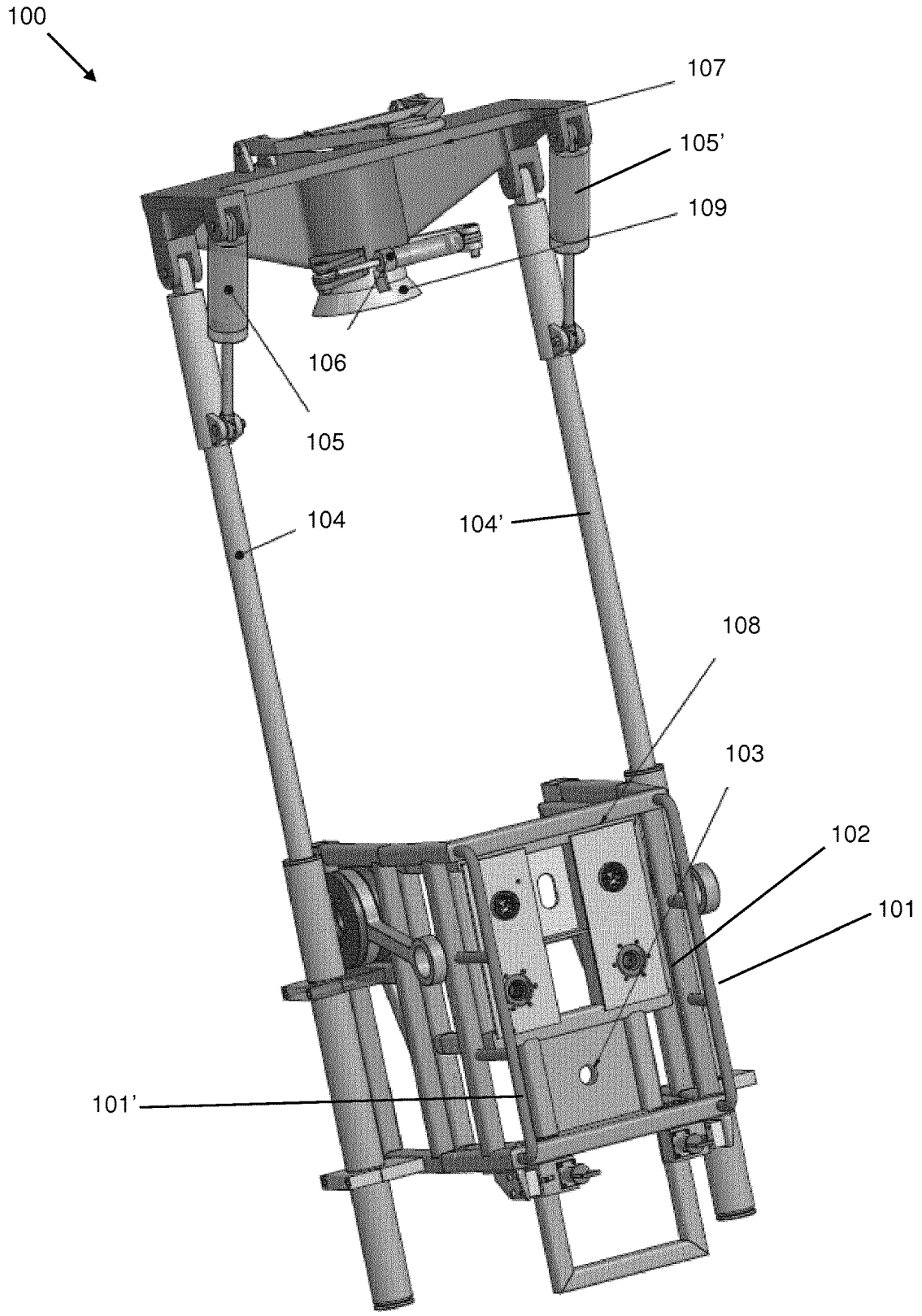
FIG. 1 shows an alignment, installation and activation apparatus according to an embodiment of the invention.

Alignment installation and activation (AIA) apparatus:

According to an exemplary embodiment, the AIA apparatus 100, illustrated in FIG. 1, comprises the following principal components:

Grabber bars 101 and 101' on each side of the frame;
ROV panel 102 with ROV valves, gauges and receptacles;
Docking plate 103 for holding component;
Cage assembly supporting docking plate 108;
Pull-in cylinders 104 and 104';
Pitch cylinders 105 and 105';
Rotation cylinder 106;
Hang off unit 107;
Docking cone 109.

Figure 2:
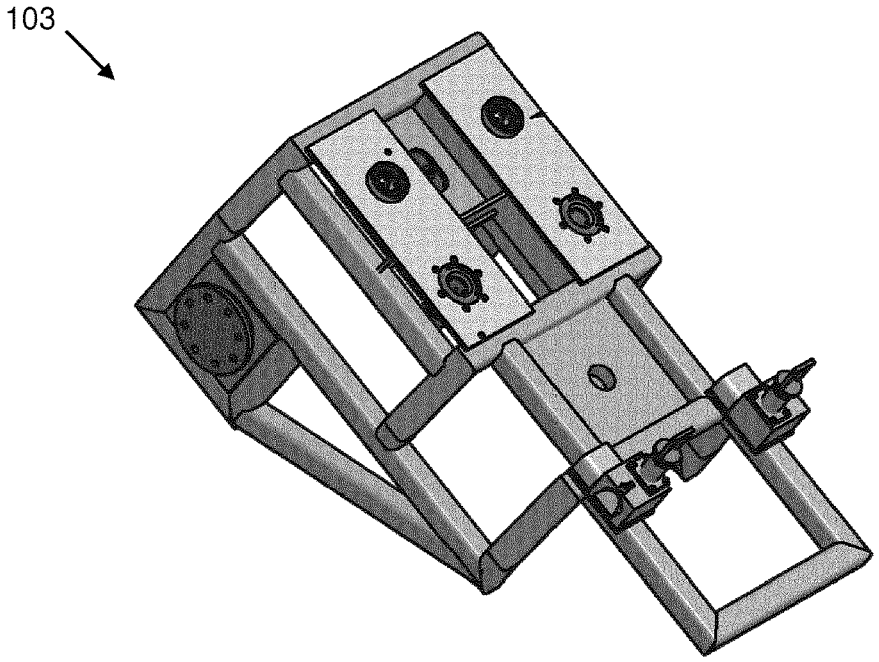
FIG. 2 shows an alignment, installation and activation apparatus according to an embodiment of the invention.
Figure 3:
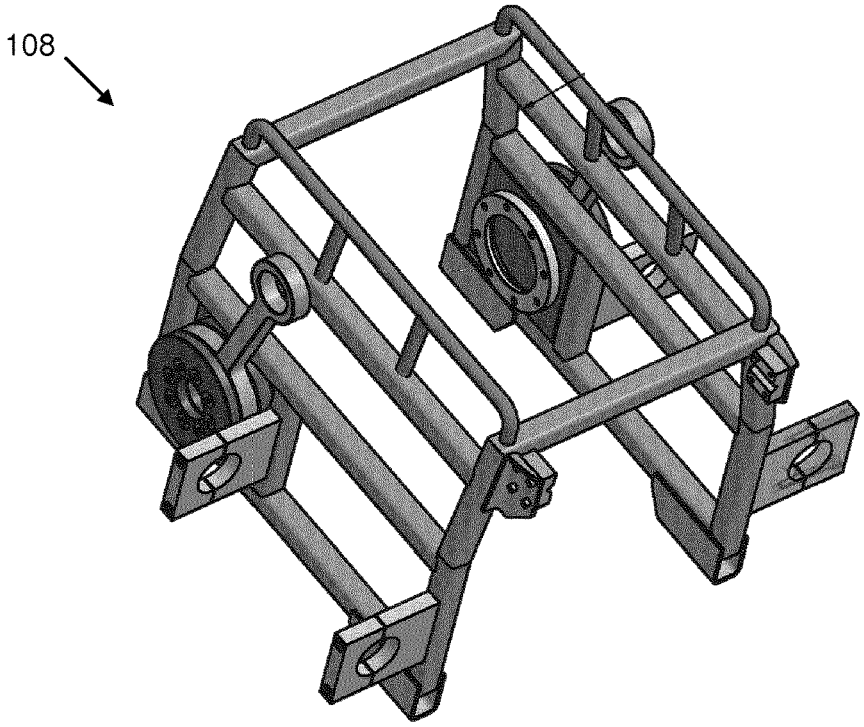
FIG. 3 shows an alignment, installation and activation apparatus according to an embodiment of the invention.
Figure 4:
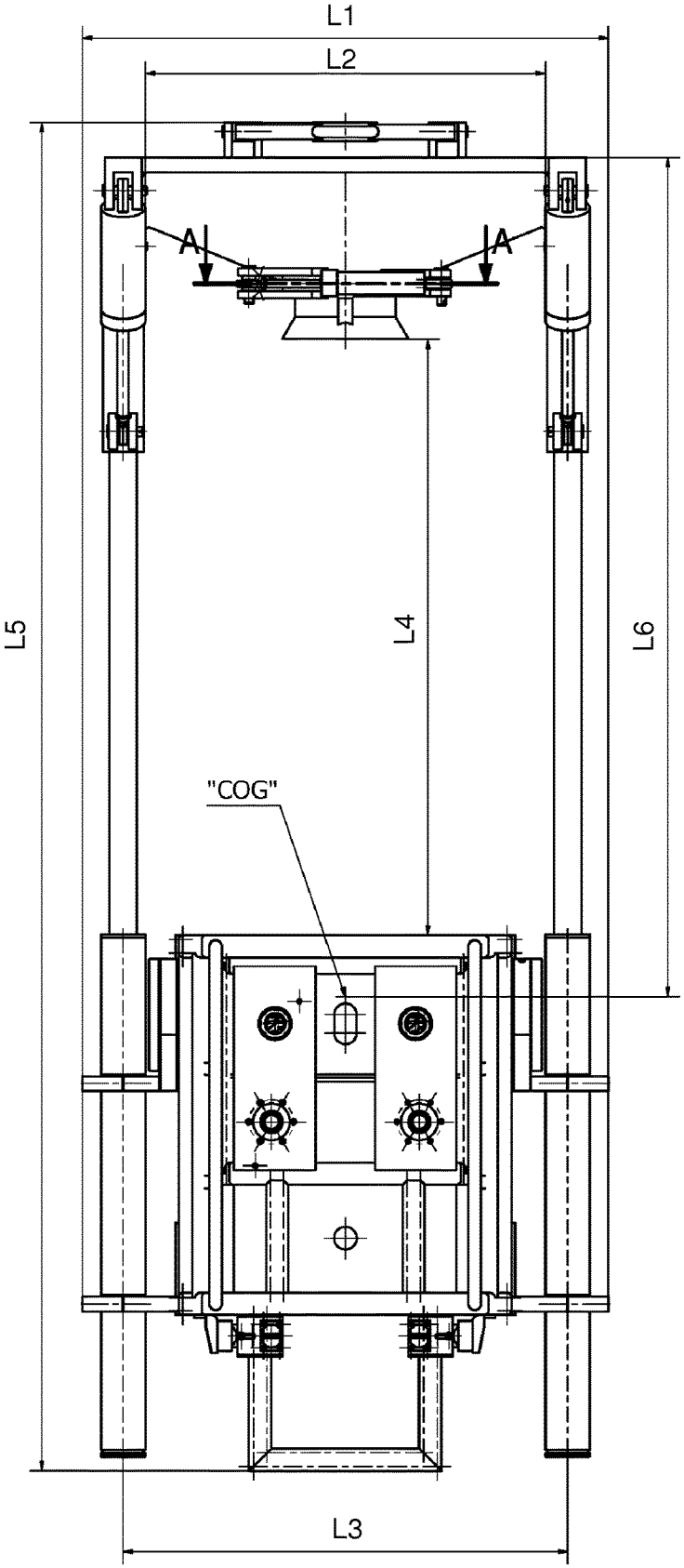
FIG. 4 shows an alignment, installation and activation apparatus according to an embodiment of the invention.
Figure 5:
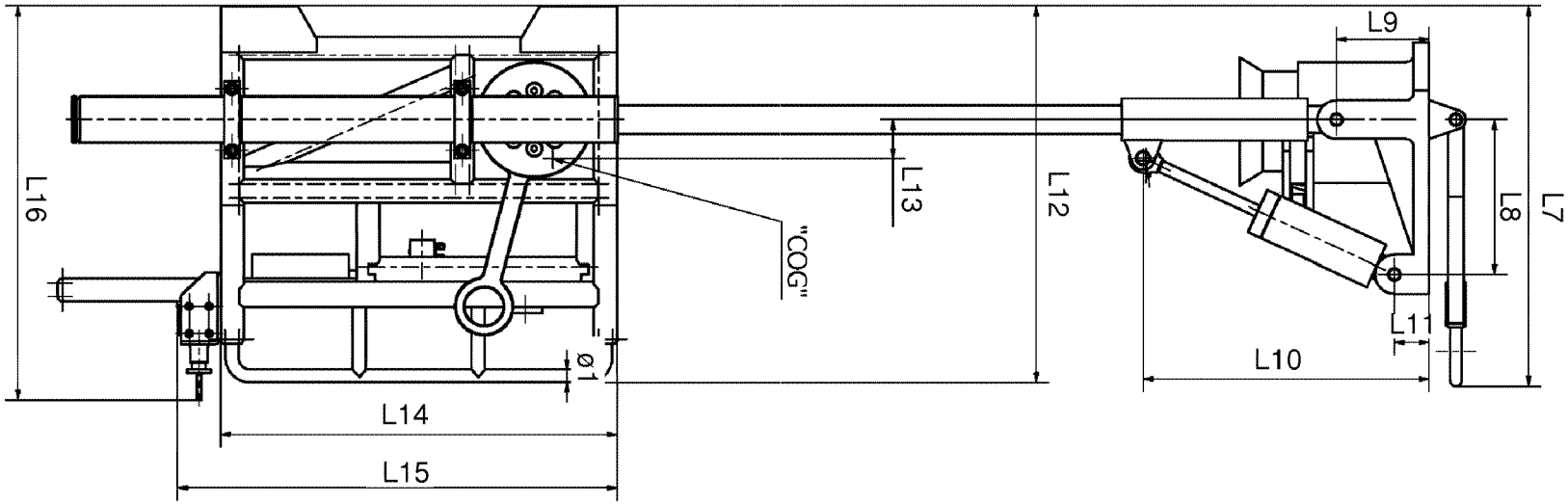
FIG. 5 shows an alignment, installation and activation apparatus according to an embodiment of the invention.
Figure 6:
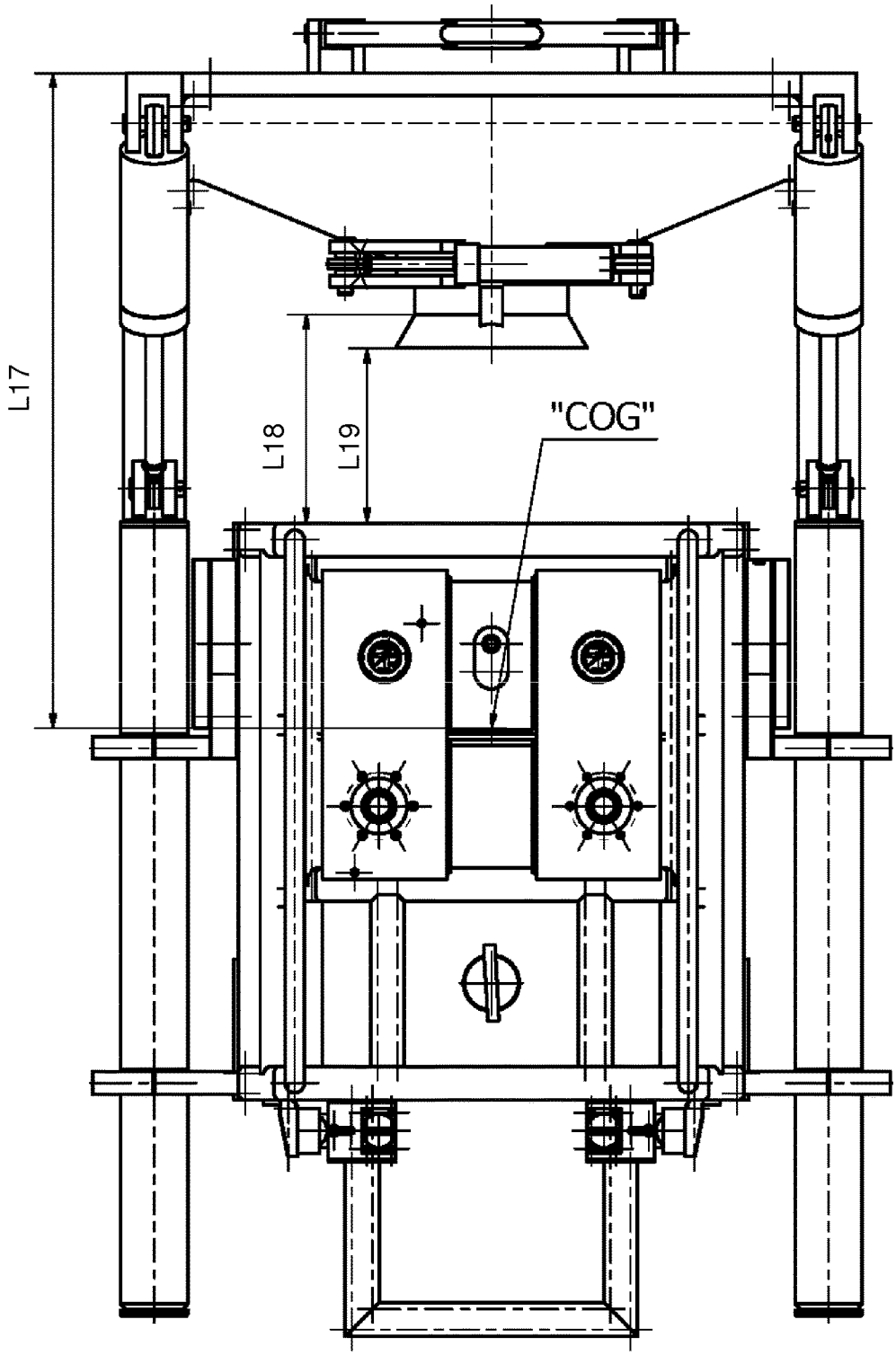
FIG. 6 shows an alignment, installation and activation apparatus according to an embodiment of the invention.
Figure 7:
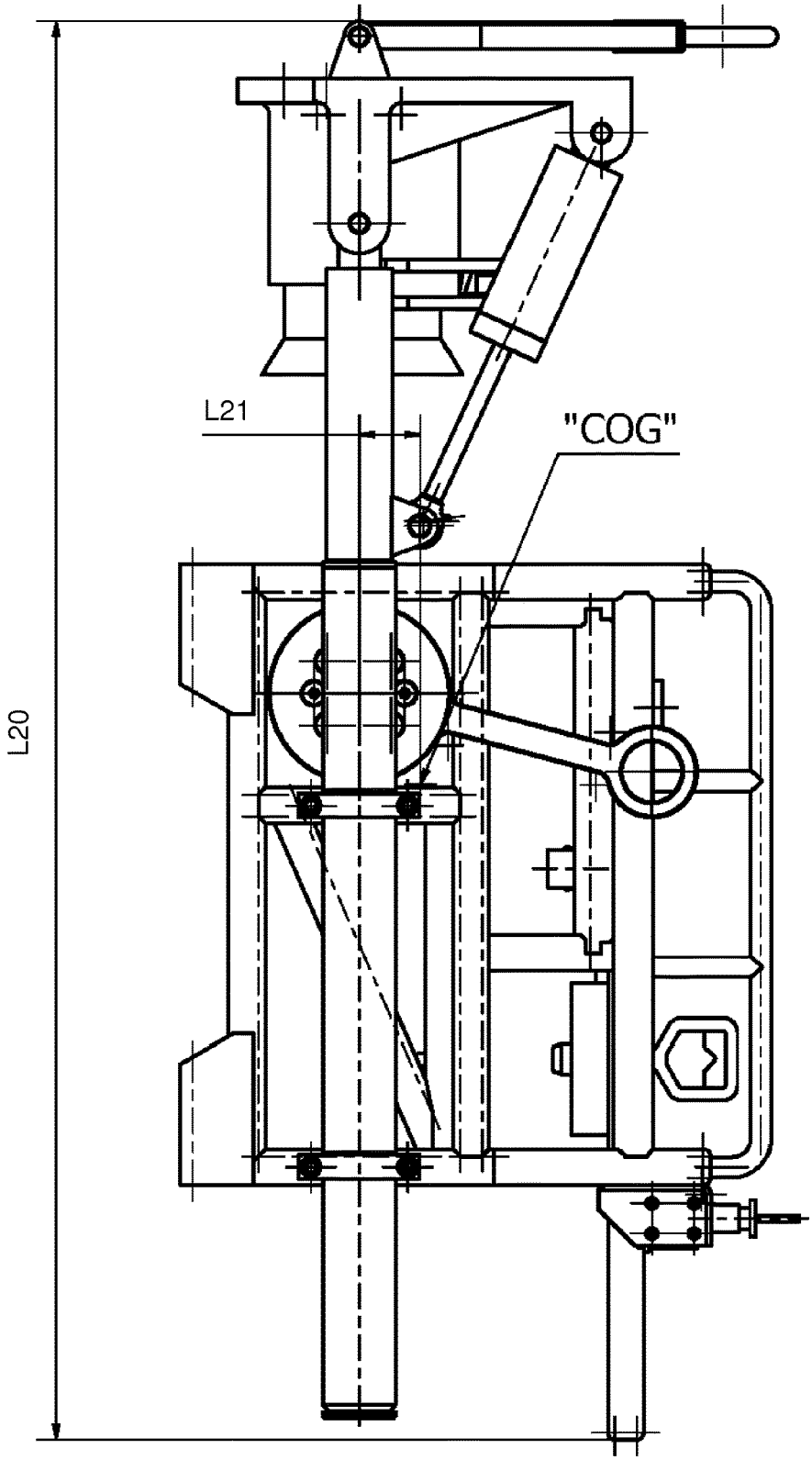
FIG. 7 shows an alignment, installation and activation apparatus according to an embodiment of the invention.
Figure 8:
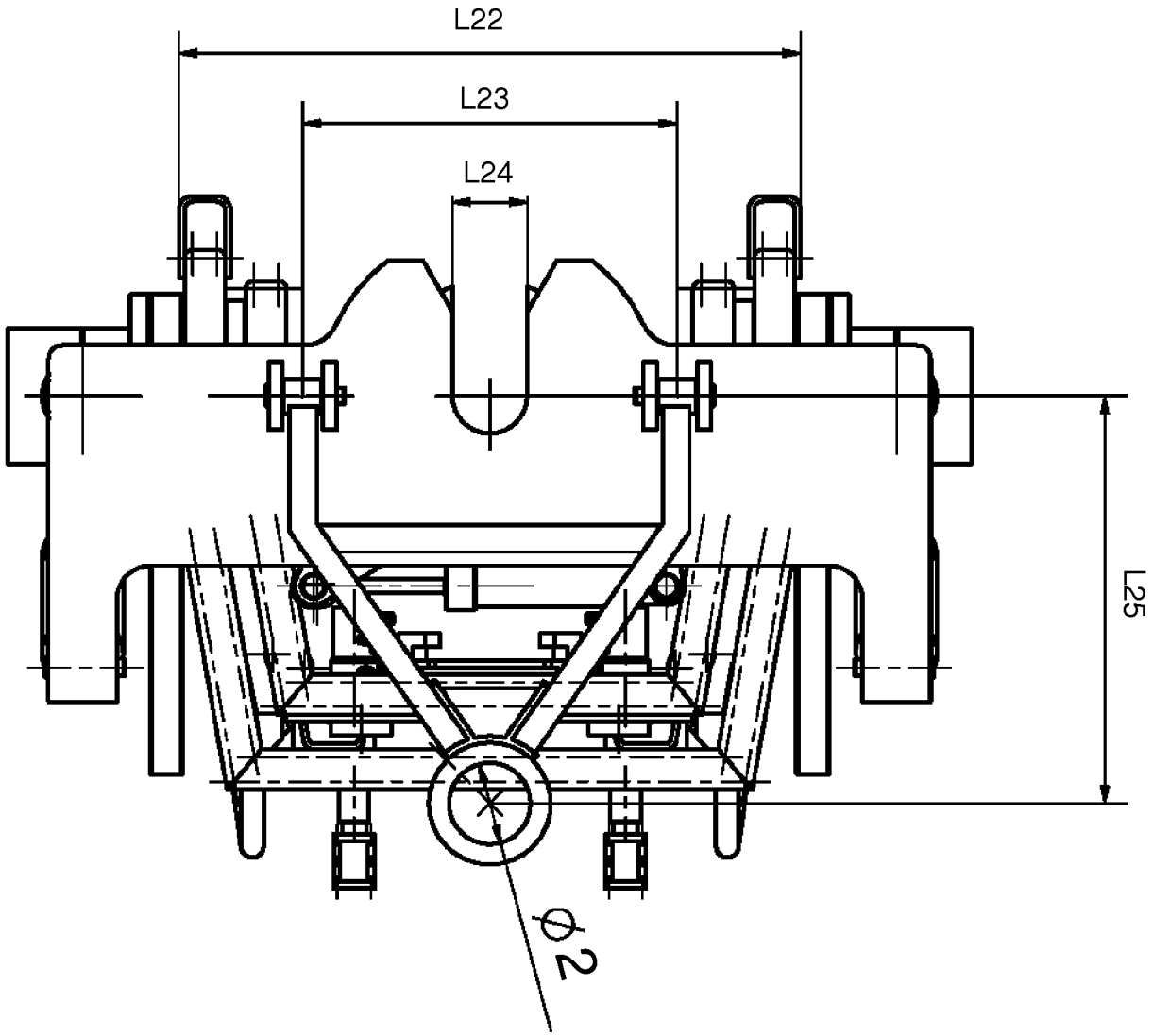
FIG. 8 shows an alignment, installation and activation apparatus according to an embodiment of the invention.
Figure 9:
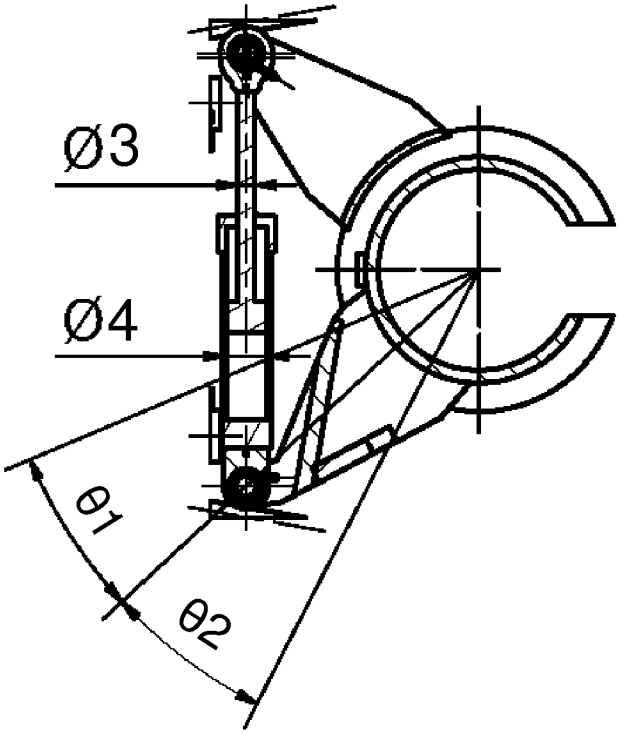
FIG. 9 shows an alignment, installation and activation apparatus according to an embodiment of the invention.
Figure 10:
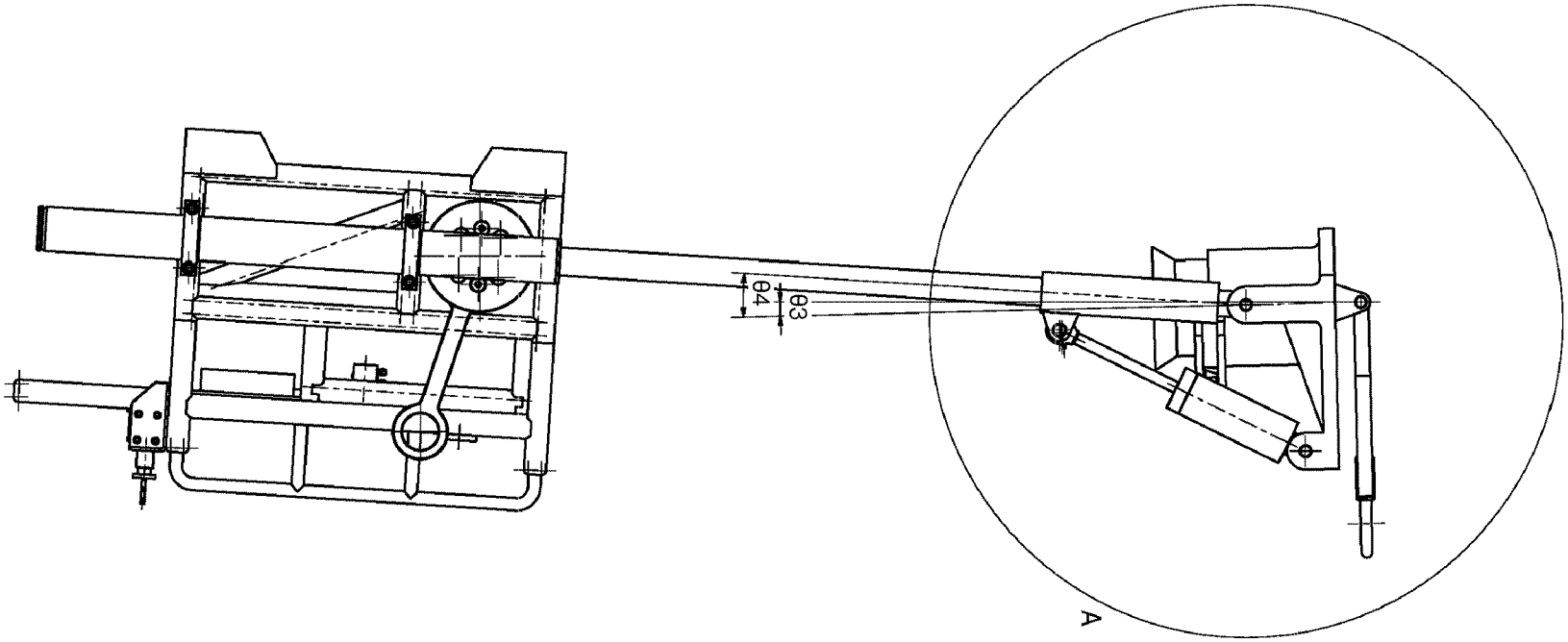
FIG. 10 shows an alignment, installation and activation apparatus according to an embodiment of the invention.
Figure 11:
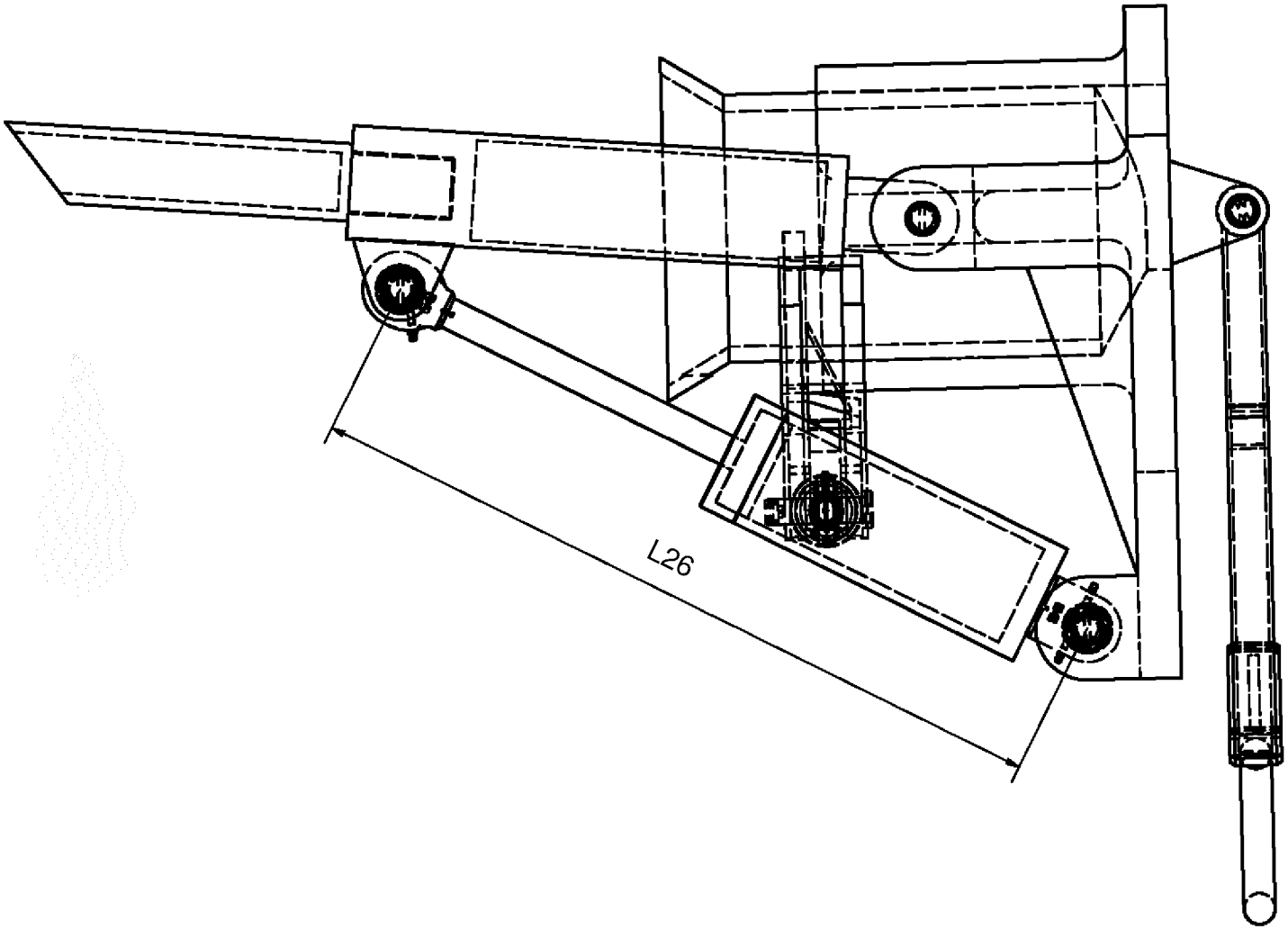
FIG. 11 shows an alignment, installation and activation apparatus according to an embodiment of the invention.
Figure 12:
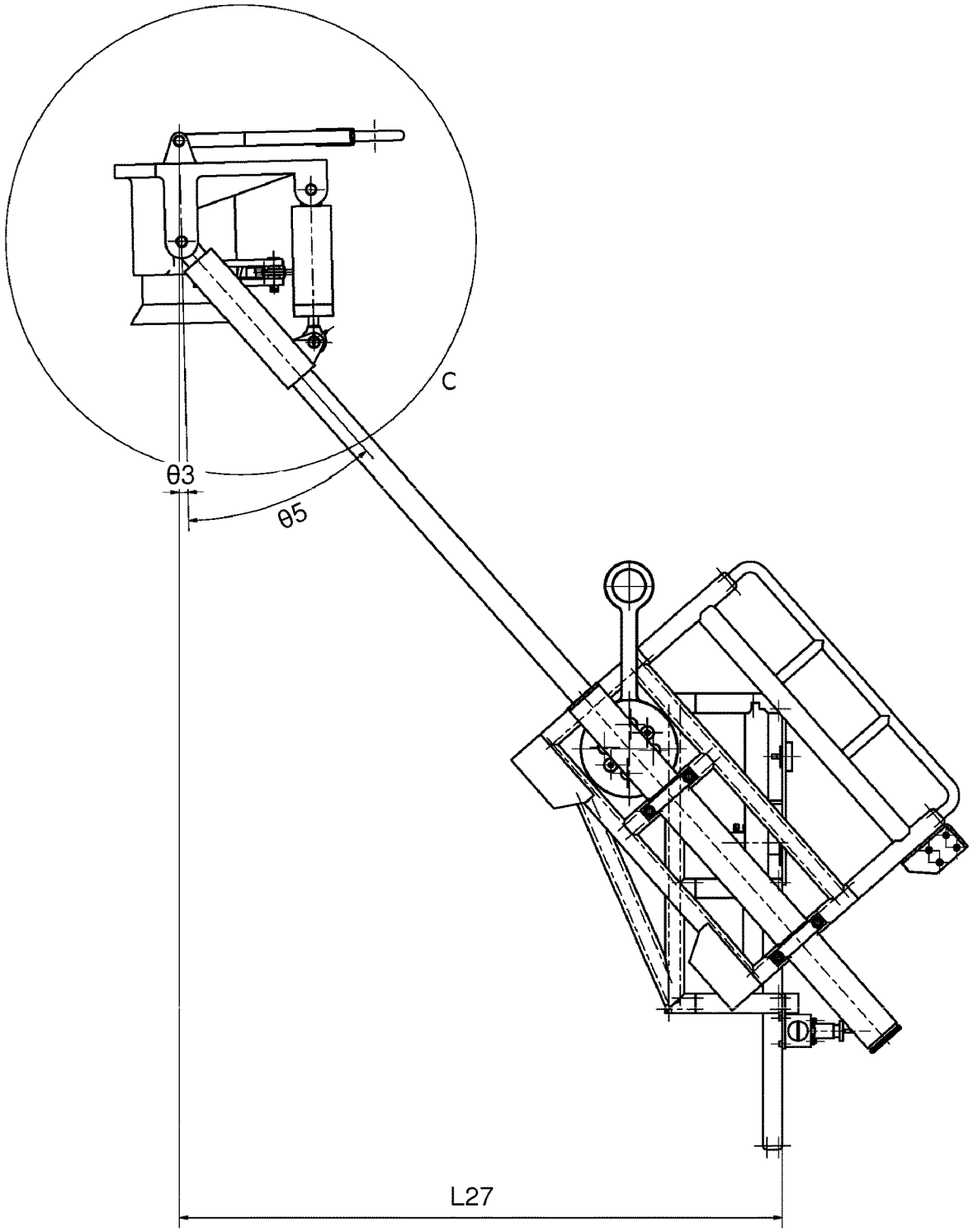
FIG. 12 shows an alignment, installation and activation apparatus according to an embodiment of the invention.
Figure 13:
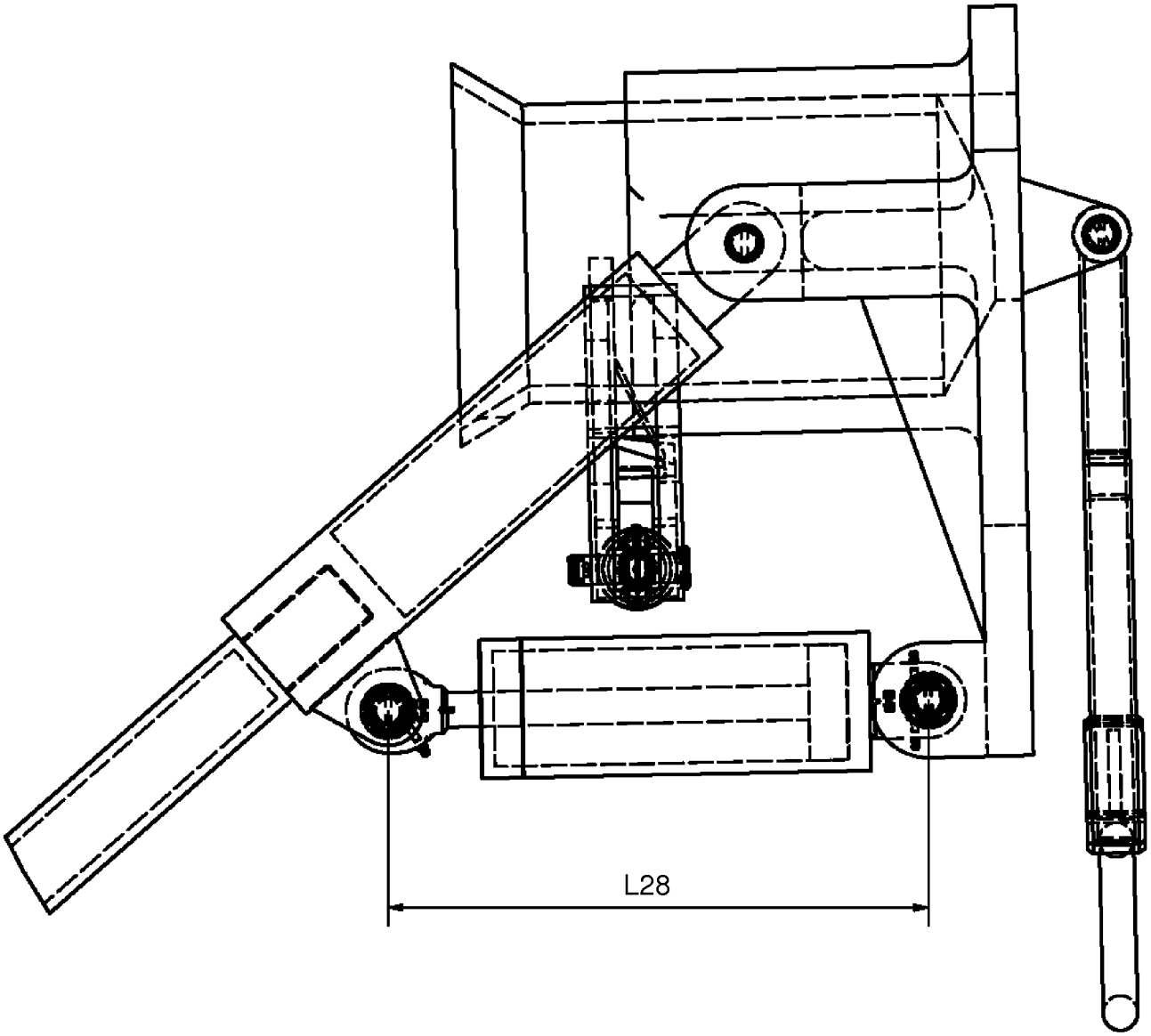
FIG. 13 shows an alignment, installation and activation apparatus according to an embodiment of the invention.
Figure 14:
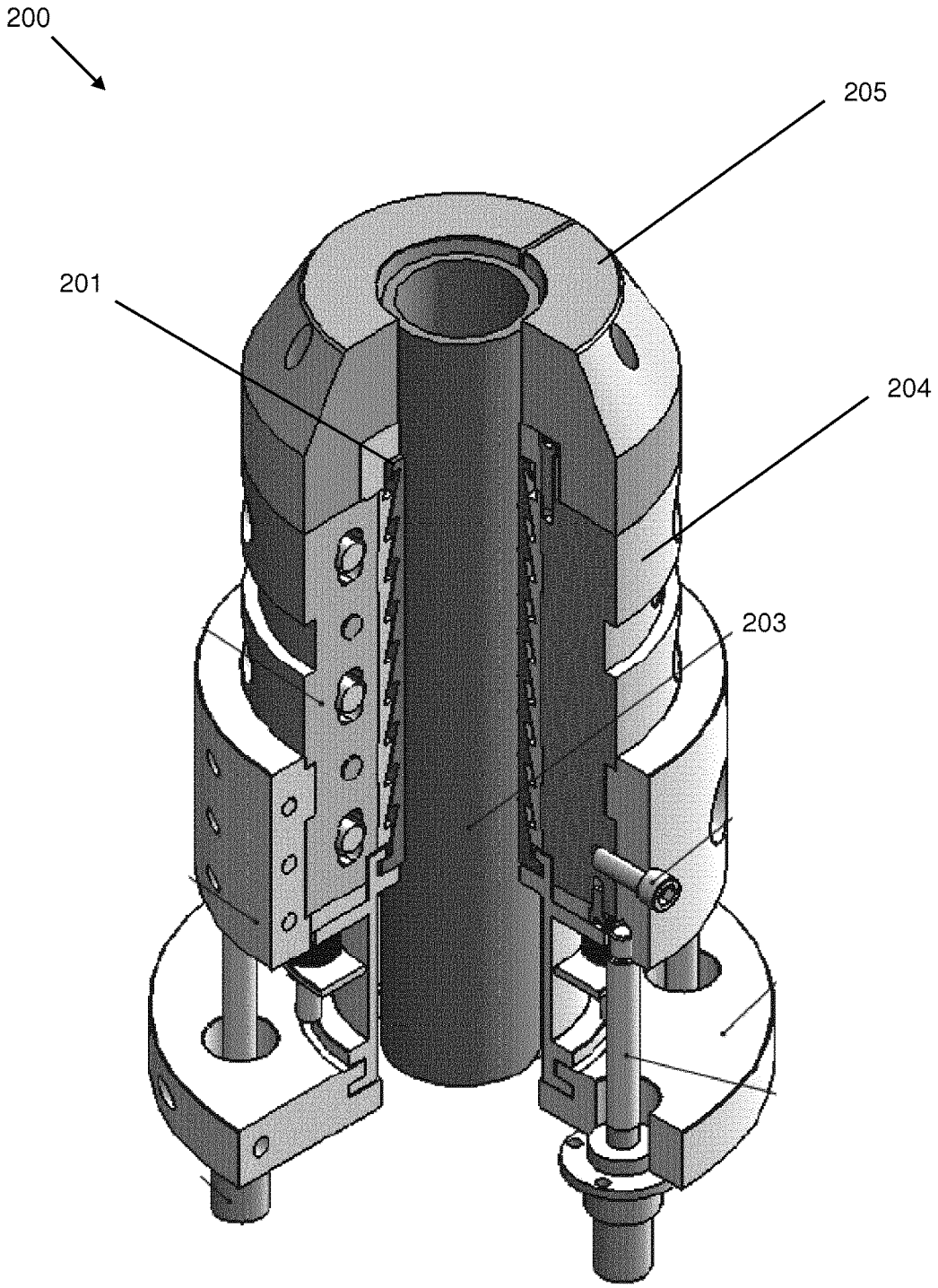
FIG. 14 shows a gripper unit apparatus according to an embodiment of the invention.
Figure 15:
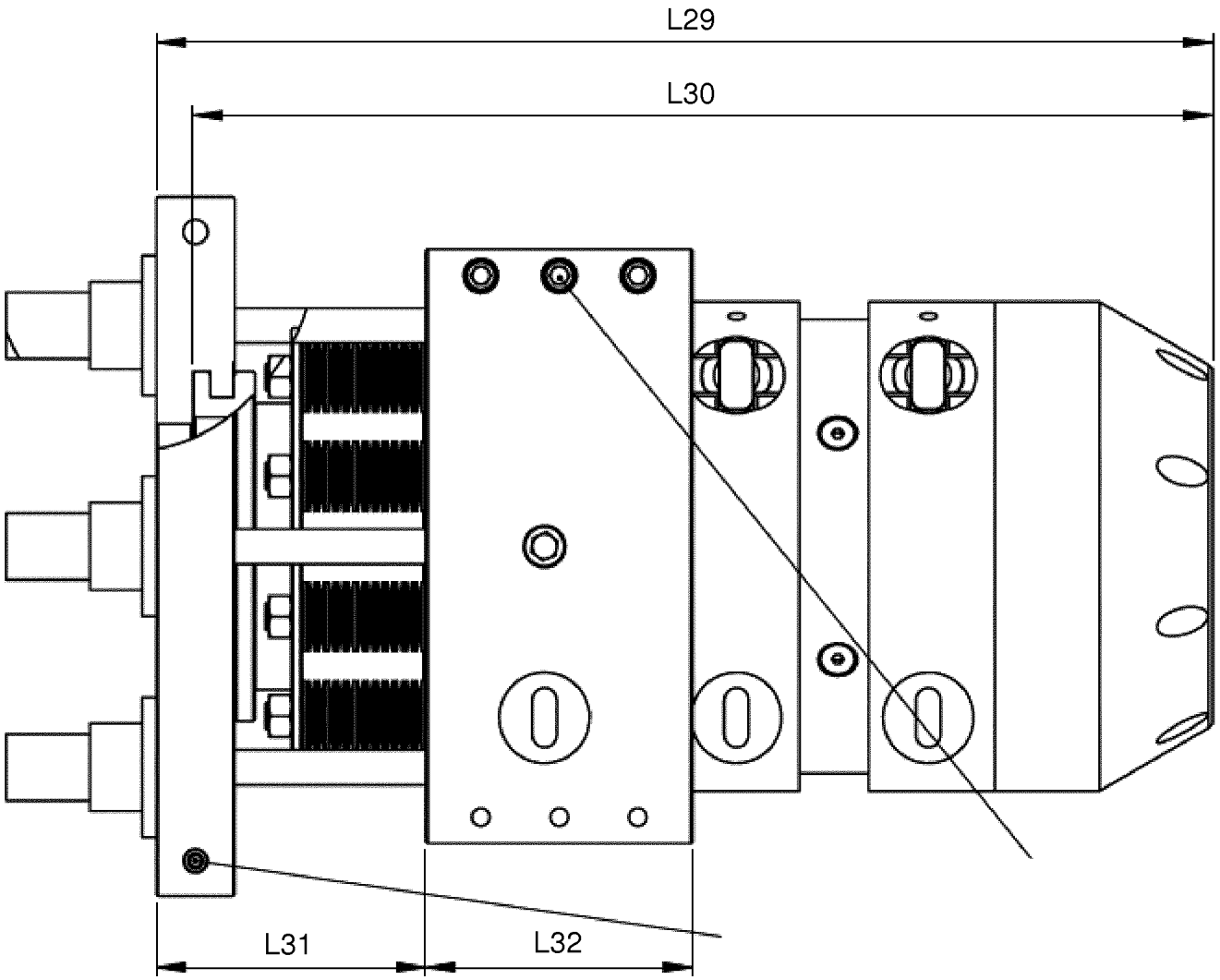
FIG. 15 shows a gripper unit apparatus according to an embodiment of the invention.

FIGS. 2 and 3 are detailed view of the docking plate 103 and cage assembly 108 respectively. Aspects of the AIA frame are described further below, with respect to the procedure for landing a component on a riser.

Non-limiting example dimensions for the AIA apparatus depicted in FIGS. 4 to 13 are given in the table below:

| Dimension | Value |
|---|---|
| L1 | 1420 mm |
| L2 | 1080 mm |
| L3 | 1200 mm |
| L4 | 1612 mm |
| L5 | 3644 mm |
| L6 | 2268 mm |
| L7 | 985 mm |
| L8 | 400 mm |
| L9 | 240 mm |
| L10 | 740 mm |
| L11 | 90 mm |
| L12 | 975 mm |
| L13 | 101 mm |
| L14 | 1027 mm |
| L15 | 1137 mm |
| L16 | 1021 mm |
| ø1 | 33.7 mm |
| L17 | 1167 mm |
| L18 | 372 mm |
| L19 | 312 mm |
| L20 | 2344 mm |
| L21 | 101 mm |
| L22 | 916 mm |
| L23 | 552 mm |
| L24 | 110 mm |
| L25 | 600 mm |
| ø2 | 120 mm |
| ø3 | 20 mm |
| ø4 | 50 mm |
| θ1 | 20° |
| θ2 | 20° |
| θ3 | 1.4° |
| θ4 | 5.0° |
| L26 | 741 mm |
| θ5 | 40° |
| L27 | 1851 mm |
| L28 | 469 mm |

Gripper Unit (GU) Apparatus:

An exemplary embodiment of a gripper unit (GU) apparatus 200 is illustrated in FIGS. 14-20. The GU should be sufficiently light-weight to allow an ROV to carry it from a basket to the worksite without crane assistance.

As load is applied to the GU, the slips segments 201 move upwards and inwards relative to the body of the unit 204 and the teeth protrude slightly into the pipe surface 203. The ultimate capacity is limited by the shear strength across the number of teeth activated. The GU also comprises a cap 205 shaped so as to interface with the docking cone 109 of the AIA frame.

As the slips will not engage around the complete circumference of the pipe, this will ensure that all alignment reaction forces introduced into the pipe will be on the part of the pipe that is circumferentially supported by the slip segments. The initial activation of the slip teeth onto the pipe is by mechanical closing of the slip carrier. This is only required to hold the weight of the unit. Thereafter the slips are self-activating. The GU has slips with longitudinal as well as transverse teeth. The longitudinal teeth will determine the torsional capacity of the GU during the subsequent rotational alignment. Some torsional forces may be introduced by the flexible riser, but these are assumed to be low.

To eliminate the need to lock the GU onto the riser pipe while suspended from the crane, with associated risk of introducing vessel dynamic forces to the riser, a light weight unit that can be launched with the ROV is proposed. The weight of the concept unit is about 50 kg.

Certain aspects of the GU include:

Light weight: ROV handling only
Nearly full circumferential pipe support
Self-activating slips
Reaction forces taken over long length
Teeth profile qualified by DnV, no fatigue issues after gripping
Pull test to ensure initial activation
Positive disengagement of slips The GU has slips with longitudinal as well as transverse teeth. The longitudinal teeth will determine the torsional capacity of the GU during the subsequent rotational alignment.

Springs 202 in the GU ensure that the slip segments will always be forced inwards (towards the pipe). The springs will always try to pull the GU body downwards relative to the slip segments. When the GU body is pulled downwards relative to the slip segments, the slip segments will be forced inwards towards the pipe. Thus the GU will at all times hold onto the pipe. In the event that the GU is subjected to a large upwards force, it might release from the pipe, but once the force is removed the GU will grip back onto the pipe due to the force provided by the springs. From a risk point of view this is a significant advantage as otherwise (i.e. without springs) the GU might fall off the pipe.

The hardened teeth bite into the pipe surface. The tooth profile from the DnV qualified clamps will be utilized. These have been checked against RP-F113 to ensure that the marks left on the pipe surface shall not initiate subsequent fatigue damage.

Non-limiting example dimensions for the GU apparatus depicted in FIGS. 14-20 are given in the table below:

| Dimension | Value |
|---|---|
| L29 | 605.5 mm |
| L30 | 584.5 mm |
| L31 | 154.5 mm |
| L32 | 153 mm |
| L33 | 584 mm |
| L34 | 300 mm |
| L35 | 125 mm |
| L36 | 70 mm |
| L37 | 53.8 mm |
| θ6 | 30° |
| ø5 | 108 mm |

Figure 17:
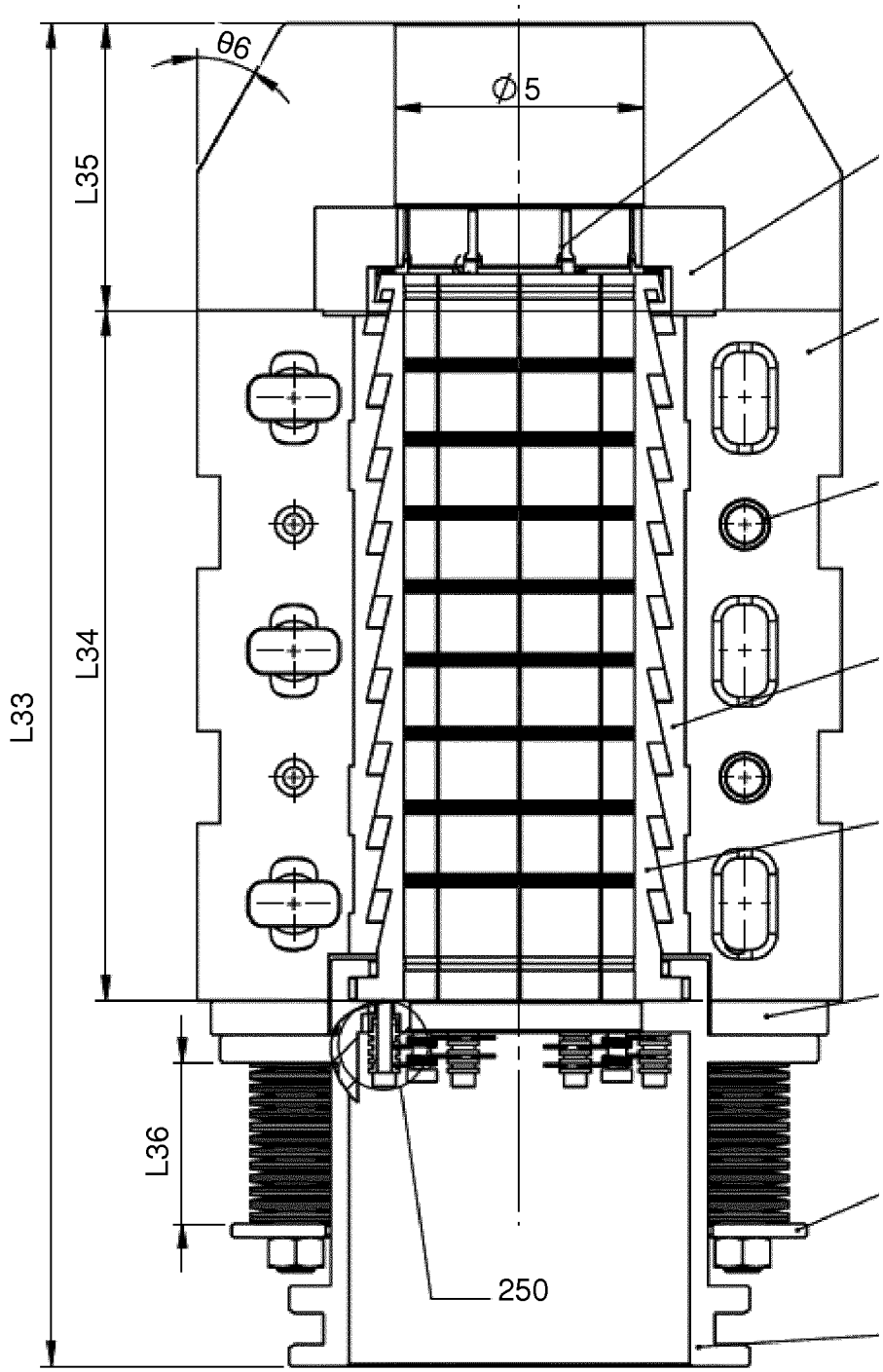
FIG. 17 shows a gripper unit apparatus according to an embodiment of the invention.
Figure 18:
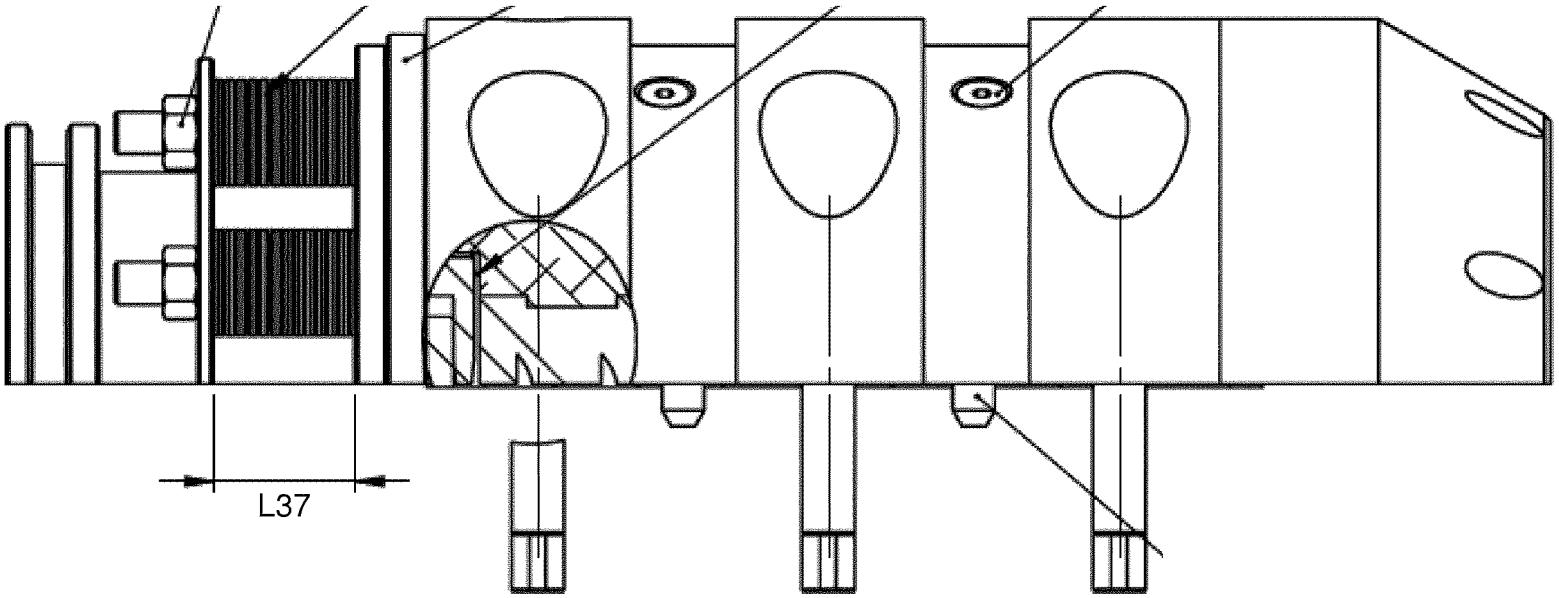
FIG. 18 shows a gripper unit apparatus according to an embodiment of the invention.
Figure 19:
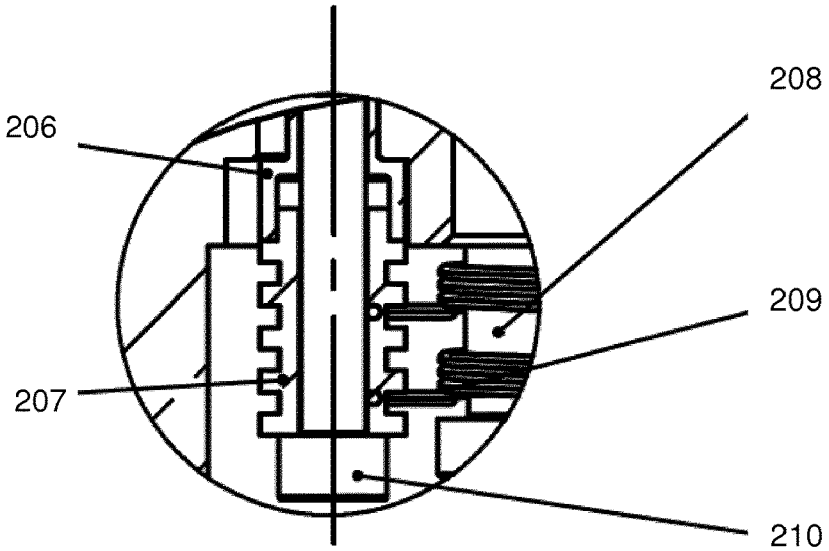
FIG. 19 shows a gripper unit apparatus according to an embodiment of the invention.
Figure 20:
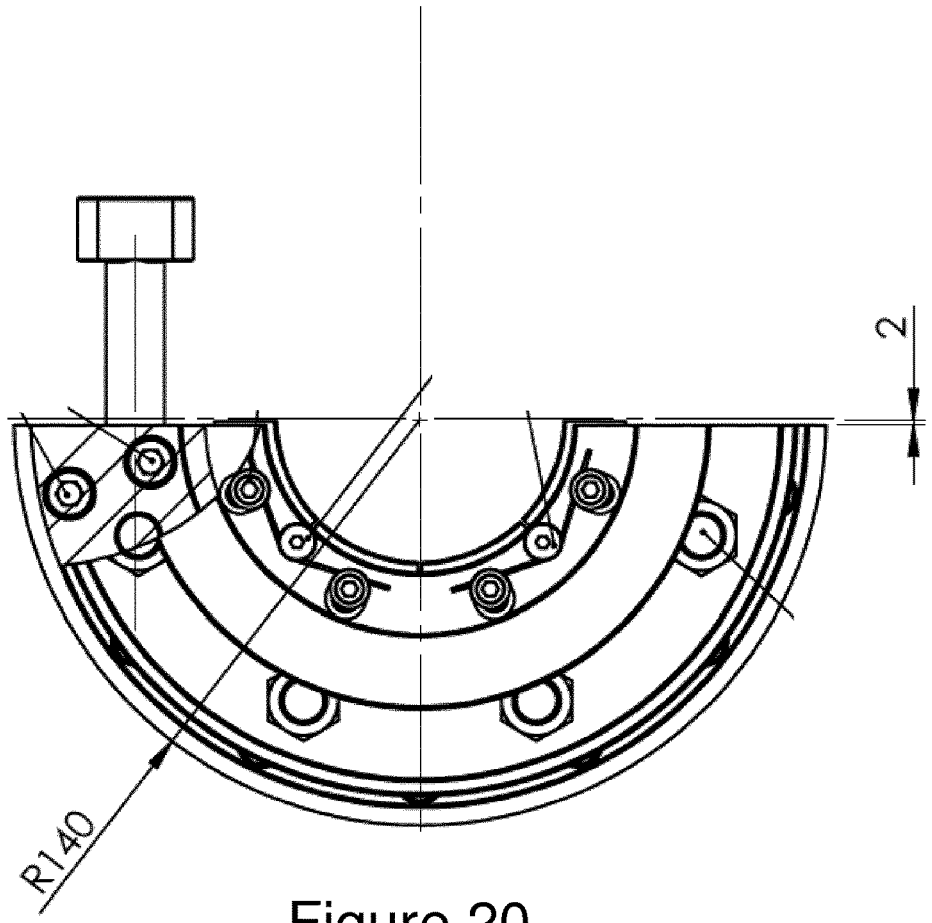
FIG. 20 shows a gripper unit apparatus according to an embodiment of the invention.
Figure 21:
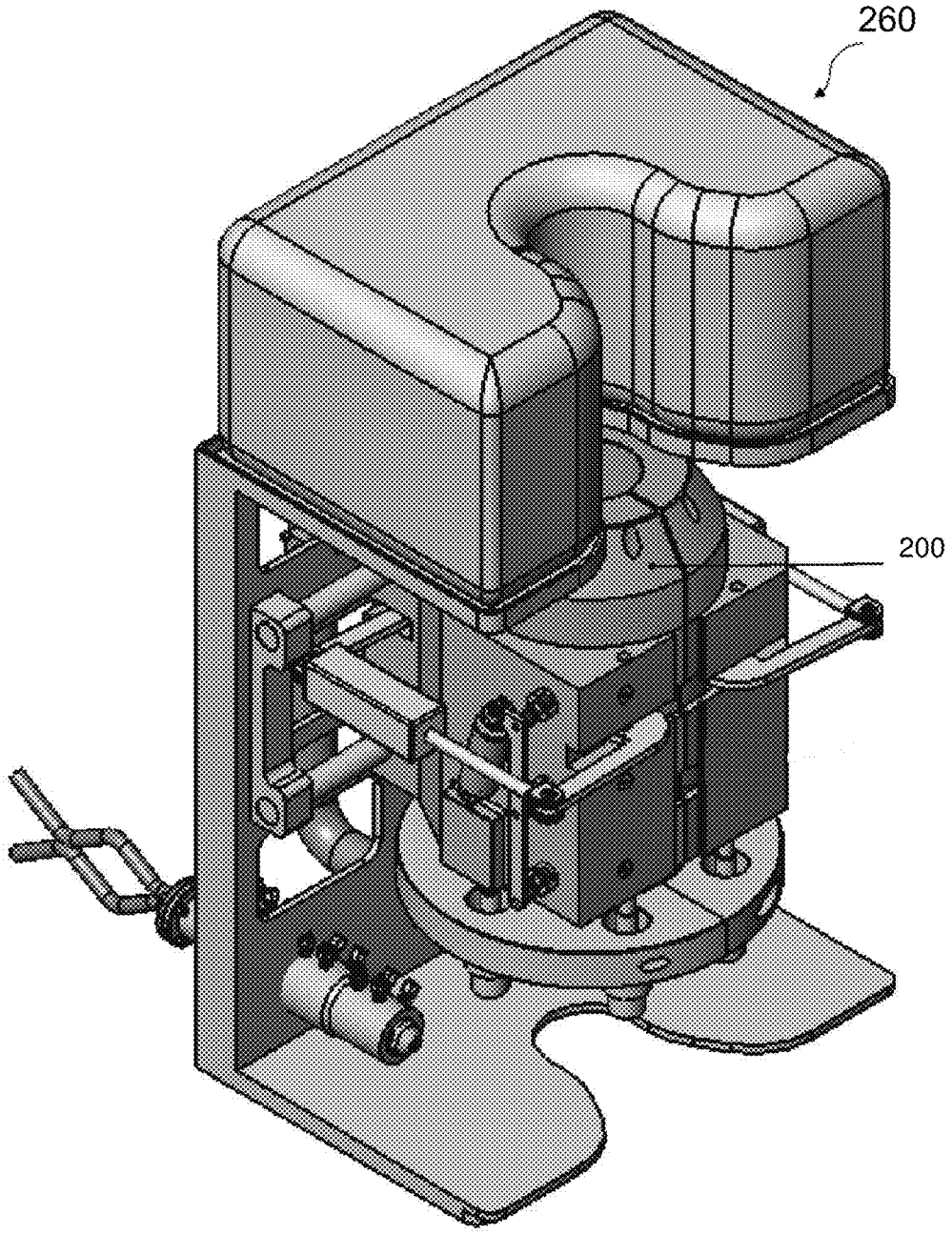
FIG. 21 shows a gripper unit apparatus installation tool according to an embodiment of the invention.
Figure 22:
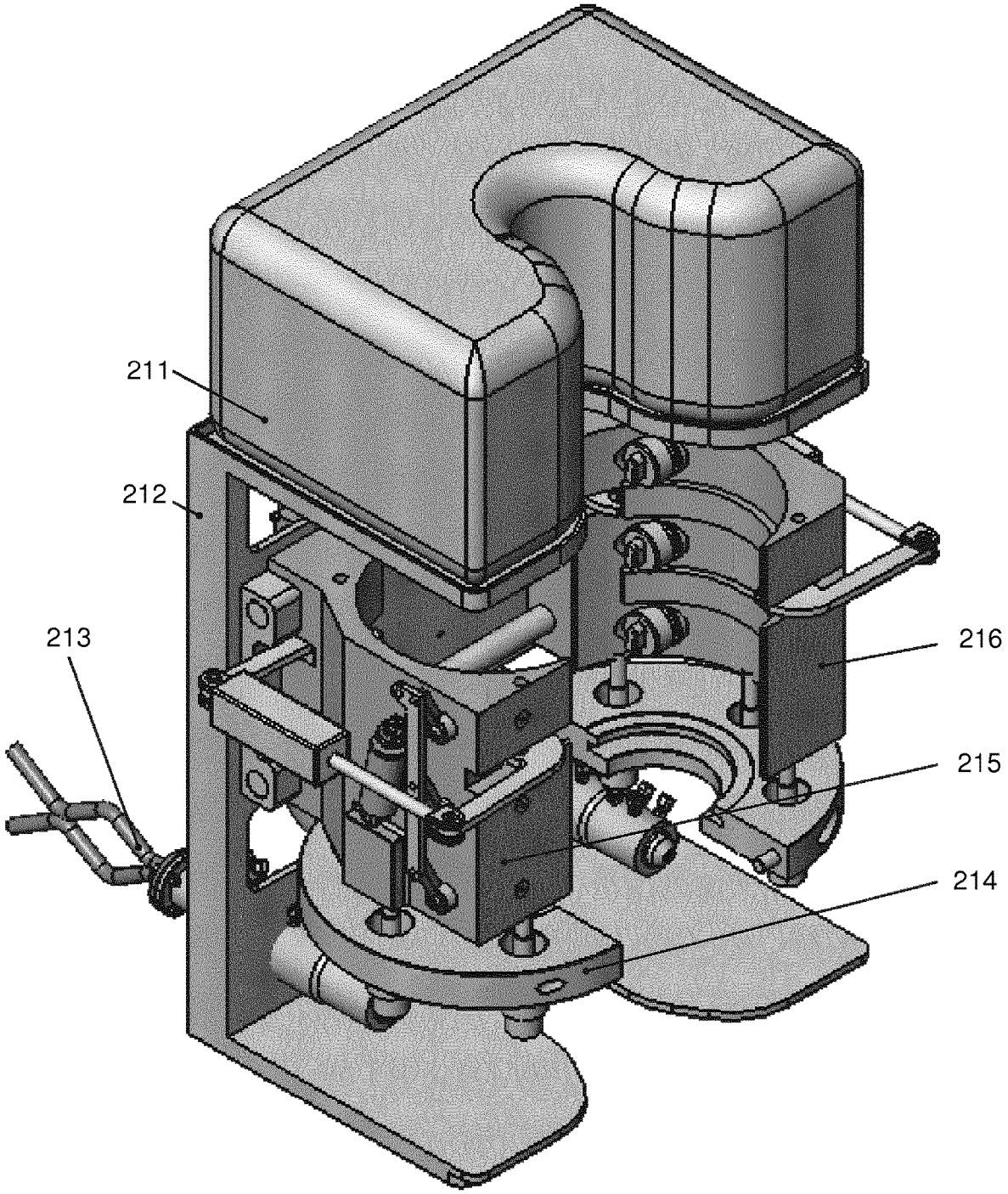
FIG. 22 shows a gripper unit apparatus installation tool according to an embodiment of the invention.
Figure 23:
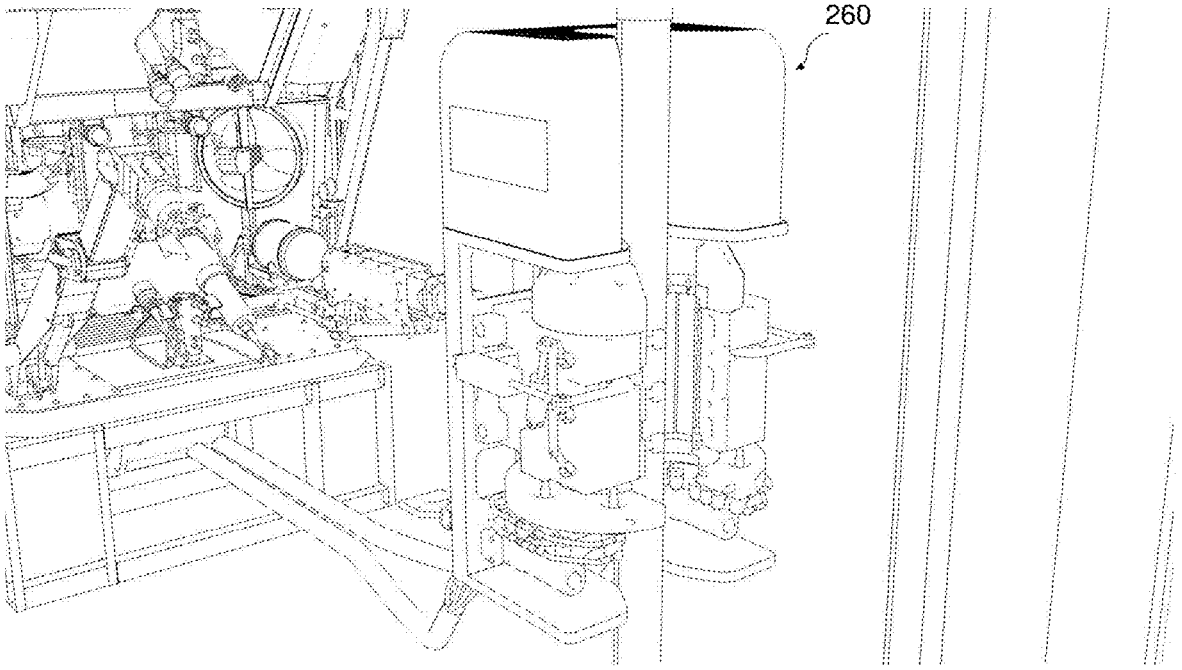
FIG. 23 shows a method step according to an aspect of the invention.
Figure 24:
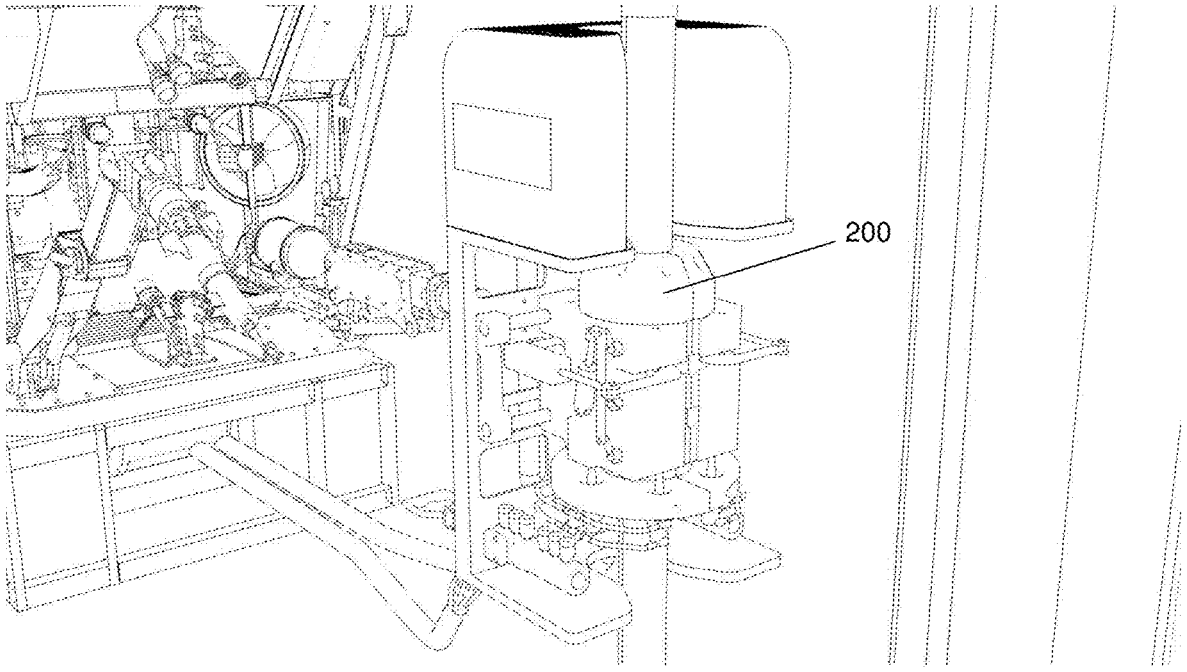
FIG. 24 shows a method step according to an aspect of the invention.
Figure 25:
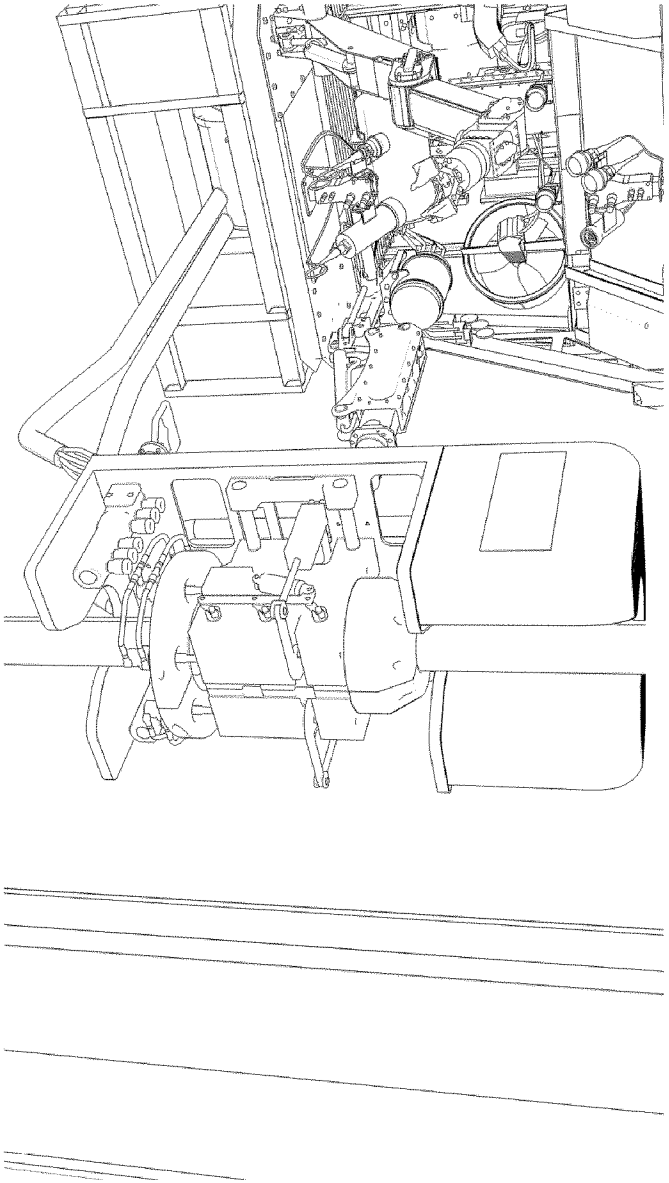
FIG. 25 shows a method step according to an aspect of the invention.
Figure 26:
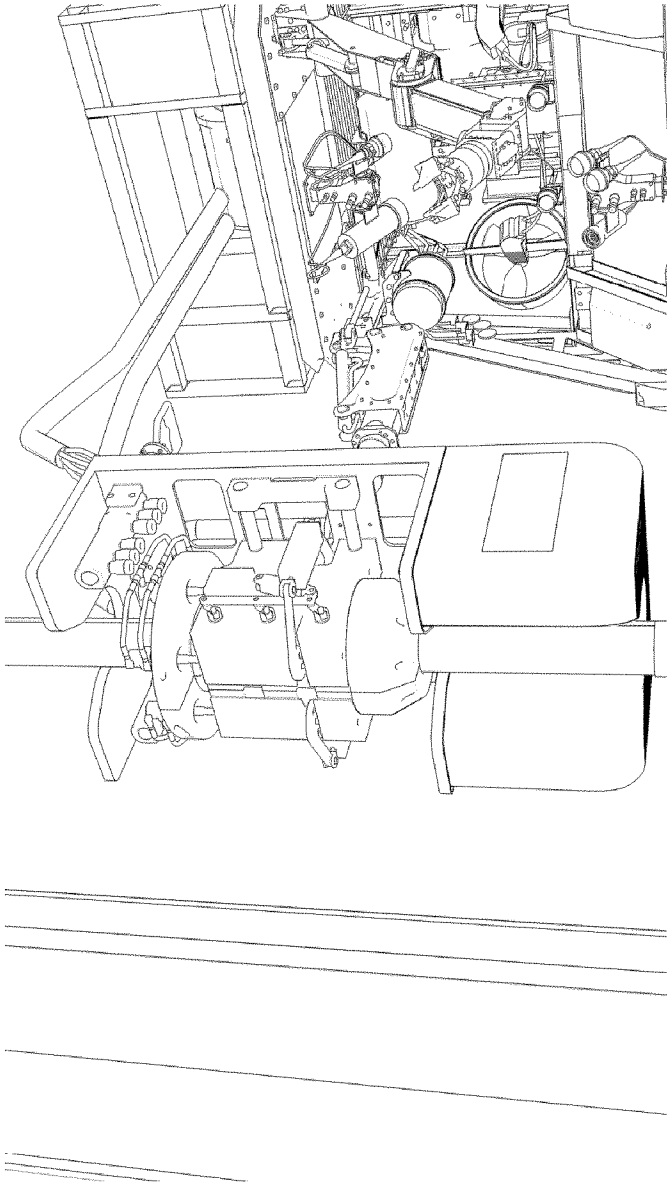
FIG. 26 shows a method step according to an aspect of the invention.
Figure 27:
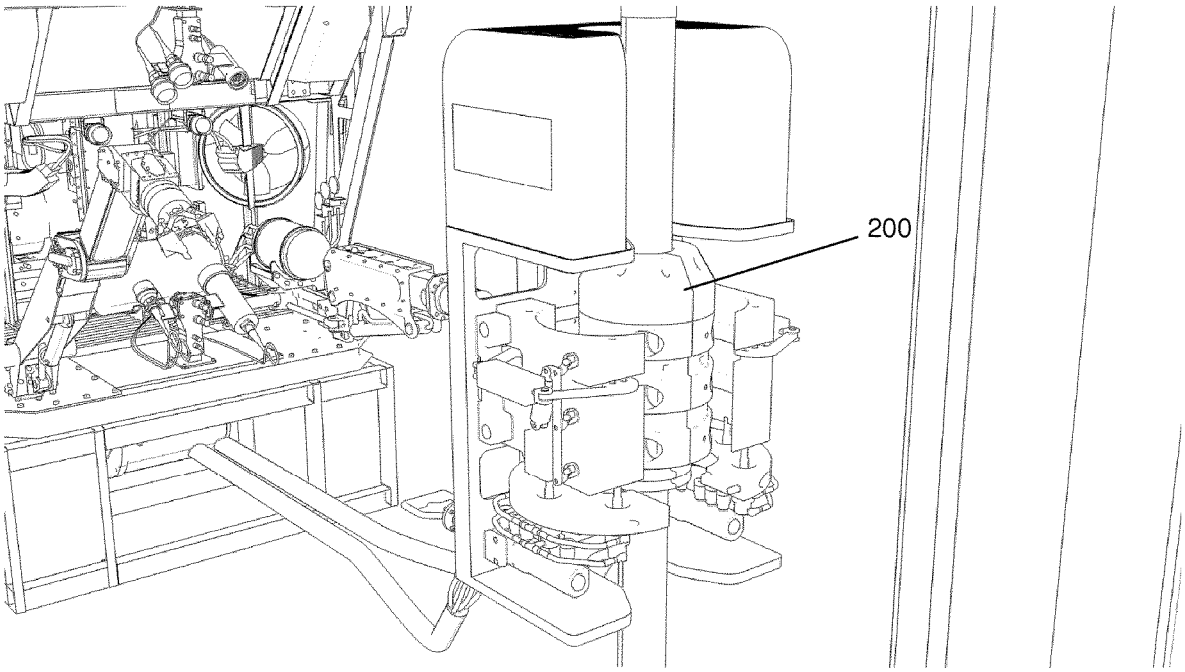
FIG. 27 shows a method step according to an aspect of the invention.

FIG. 19 is a close-up view of the encircled region (labelled 250) in FIG. 17, where 206 is a spring lower shell; 207 is a spring support; 208 is a screw (e.g. M8×16); 209 is a torsion spring; and 210 is a screw (e.g. M6×40). FIG. 20 is a bottom view of the GU apparatus. FIGS. 21 and 22 show an installation tool 260 for installing the GU apparatus 200 on a riser, where 211 is a buoyancy aid; 212 is the installation tool frame; 213 is a 6-line hot stab; 214 is a flange with cylinders for activation; 215 is a left running tool gripper; and 216 is a right running tool gripper.

Figure 16:
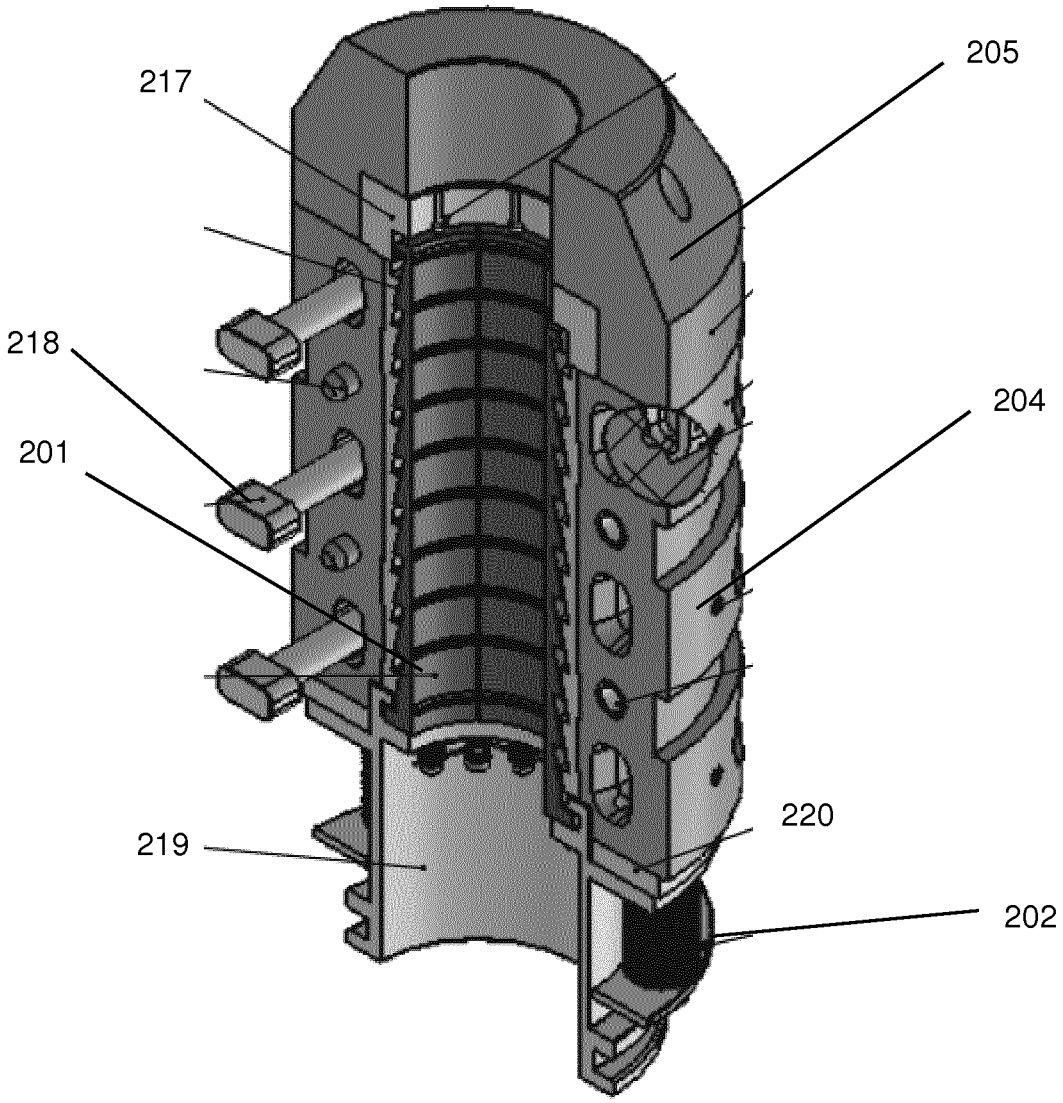
FIG. 16 shows a gripper unit apparatus according to an embodiment of the invention.

Other aspects of the GU apparatus as illustrated in FIG. 16 include: upper half shell 217; locking bolt 218; bottom half shell 219; and disc springs flange 220.

Outline of Procedure for Landing a Component on a Riser:

In the following, an exemplary method for landing and installing a component (e.g. a flange adaptor) on a riser is outlined. The main method steps are depicted, in sequence, in FIGS. 23 to 39. It should be noted that certain steps may be omitted. Furthermore, although the below steps are directed towards a riser which is supported by a riser tower, one skilled in the art will appreciate that the method is also applicable to a riser which is independently suspended.

0) Perform initial cutting of the riser pipe 301; secure the lower section of the riser pipe once cut in a cofferdam provided on the riser tower 302; cut the piggyback straps above the cutting point to allow the bottom end of the upper section of the riser pipe to be moved out from the riser tower; install a riser jacking tool 303 (RJT) on the riser tower, above the cut; jack the bottom end of the upper section of the riser pipe (hereafter referred to as the "riser pipe") outwards from the riser rower; cut a 2 metre long section from the end of riser pipe; remove pipe coating; and prepare end of pipe.

1) Perform a pre-survey to determine the extent of the lean of the riser tower and identify the heading of a 3 metre long straight section at the bottom of the riser pipe. The readings from a hydro-acoustic position reference transponder and high-precision acoustic position transponder on the riser tower buoyancy tank and remotely operated vehicle should be sufficient for the accuracy required. If the heading identified is within +/−20 degrees error margin, the rotation in the gripper unit (GU) apparatus 200 can correct for it.

2) Perform initial testing of all systems on the deck of the vessel.

3) Launch from the vessel the tool basket containing the GU apparatus 200 and a subsea marker. Alternatively these may be launched with the ROV 304. It should be ensured that the buoyancy tank and dynamic risers are avoided to prevent damage thereto.

4) Mark a 12 o'clock position 1.25 m from the end of the riser pipe. Also mark ROV grabber exclusion zones. The RJT may be retracted slightly to allow the ROV to grab onto the riser tower and be in a more stable position when performing the marking. The distance from the riser pipe end has a tolerance of +/−50 mm that can be corrected using the pull-in cylinders on the AIA frame 100. The distance is measured from the riser pipe end with a prefabricated L-shaped piece of tubing with magnets attaching it to the pipe, while the mark is made with the ROV. The mark is made with a subsea 'crayon' type stick. The IKM Technique Subsea Marker (http://www.ikm.com) may be used, for example. Care should be taken to ensure that the lower 250 mm of the riser pipe, and the 250 mm just below the GU apparatus are not be damaged by the ROV 5-function manipulator, as these areas are the primary and contingency sealing areas for the flange adaptor 306.

5) Grip onto the allowed grabbing zone on the pipe with the left hand ROV 5-function 'grabber'. Install and activate the GU apparatus 200 using the installation tool 260 operated by the ROV's 7-function manipulator, as depicted in FIGS. 23-27. The GU apparatus is installed with the open slot perpendicular to the pipe bending plane. The activation is by turning an ROV handle clockwise using the wrist rotate function. The pitch of the threaded connection that activates the slips should be selected to ensure sufficient grip based on an applied torque of 100 Nm, for example.

6) Perform vertical pull test on GU apparatus using the ROV. Pull between the left hand grabber and the right hand 7-function manipulators. The left hand grabber may be holding onto the riser pipe below if possible, or the RJT may be used to bring the riser pipe closer to the riser tower thereby allowing the ROV to grab onto another riser tower pipe. This verifies initial engagement of the GU apparatus towards the riser pipe, and starts weight setting the teeth into the riser pipe wall. The vertical pull test is limited by the force capacity of the 7-function manipulator, but is only required to prove initial activation to support the weight of the GU apparatus itself.

7) Check the elevation and heading of the installed GU apparatus. A vertical allowance for incorrect installation may be +/−50 mm as measured from the riser pipe end. Correct installation within this tolerance is deemed to be uncomplicated to achieve with a prefabricated L-shaped measuring tool.

8) Rig the AIA apparatus and connected flange adapter and flexible riser for deployment by the vessel crane. The in-water center of gravity may be calculated to allow a 45 degrees deployment angle with the GU apparatus docking unit aligned with the riser pipe axis. In addition, the AIA apparatus may have an adjustable lifting point, to allow adjustment on site for the correct suspended angle.

9) Deploy and lower the AIA frame and flexible riser to the working depth. The net resultant force from the flexible riser will depend on whether the other end of the flexible riser is suspended from a second crane or winch. The lifting points will be designed in accordance with DnV Offshore standards (available at: https://rules.dnvgl.com/servicedocuments/dnv).

Figure 28:
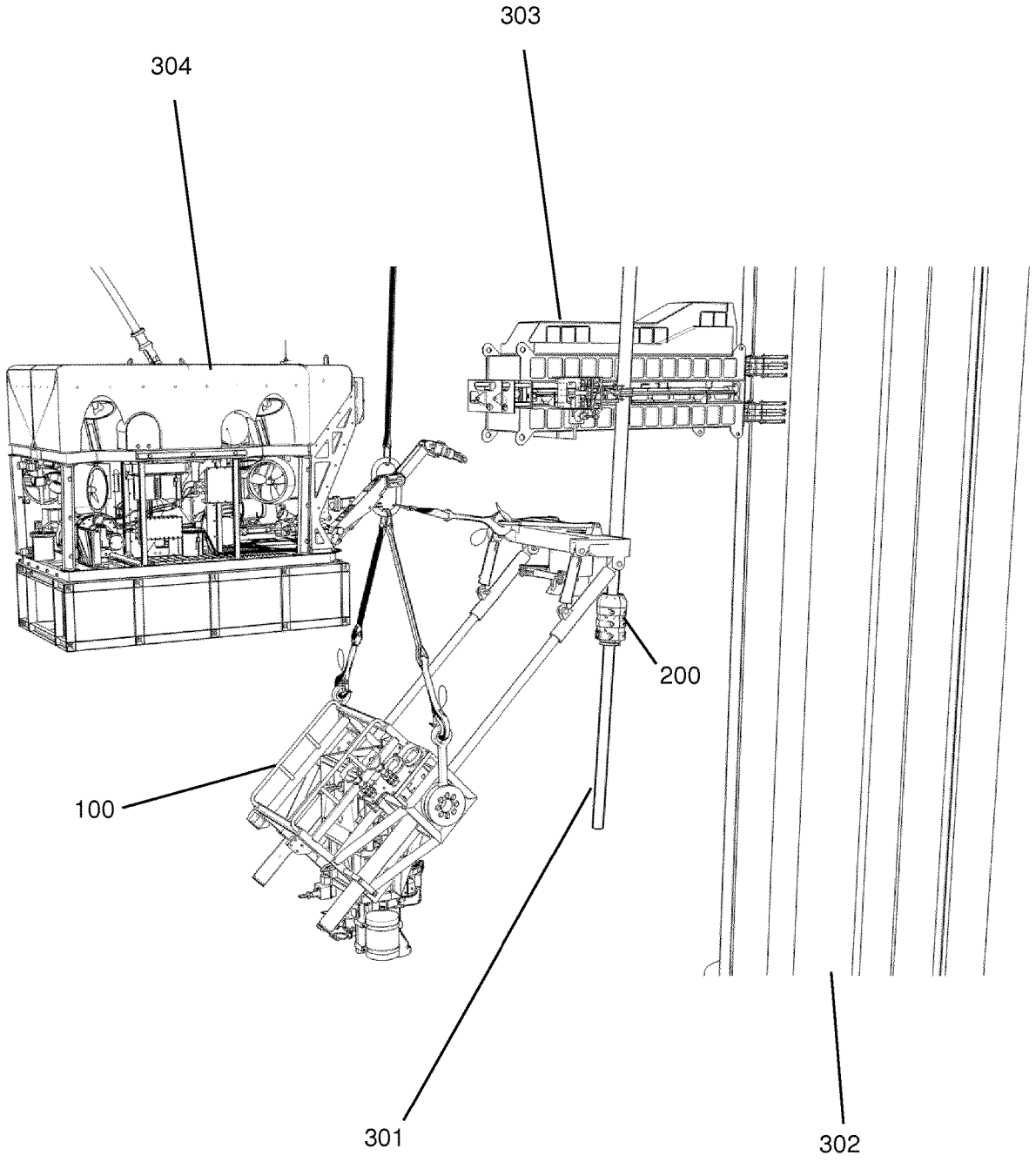
FIG. 28 shows a method step according to an aspect of the invention.
Figure 29:
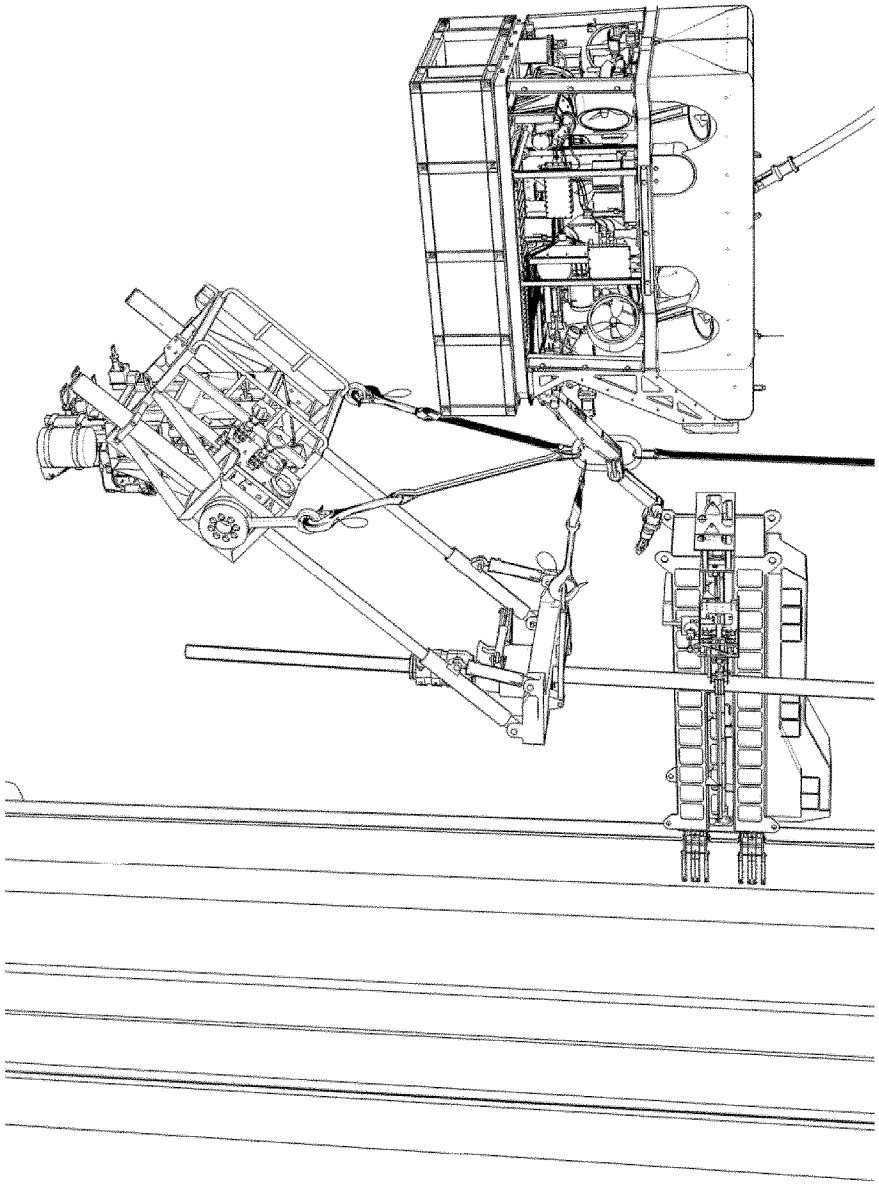
FIG. 29 shows a method step according to an aspect of the invention.
Figure 30:
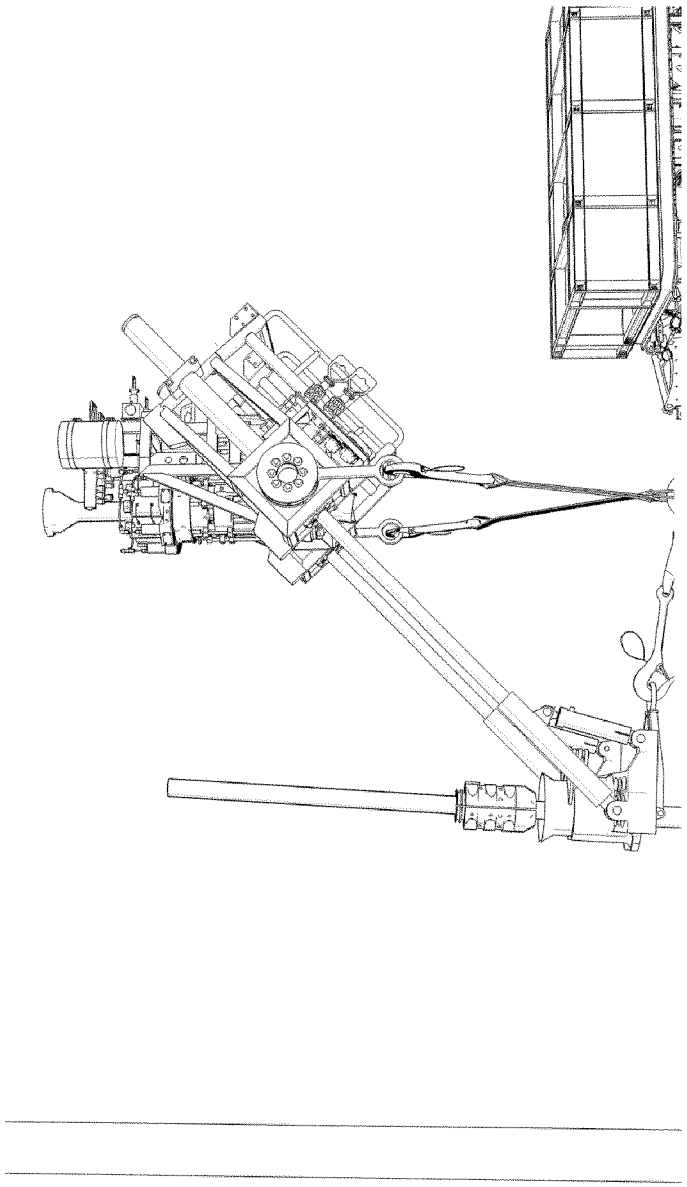
FIG. 30 shows a method step according to an aspect of the invention.
Figure 31:
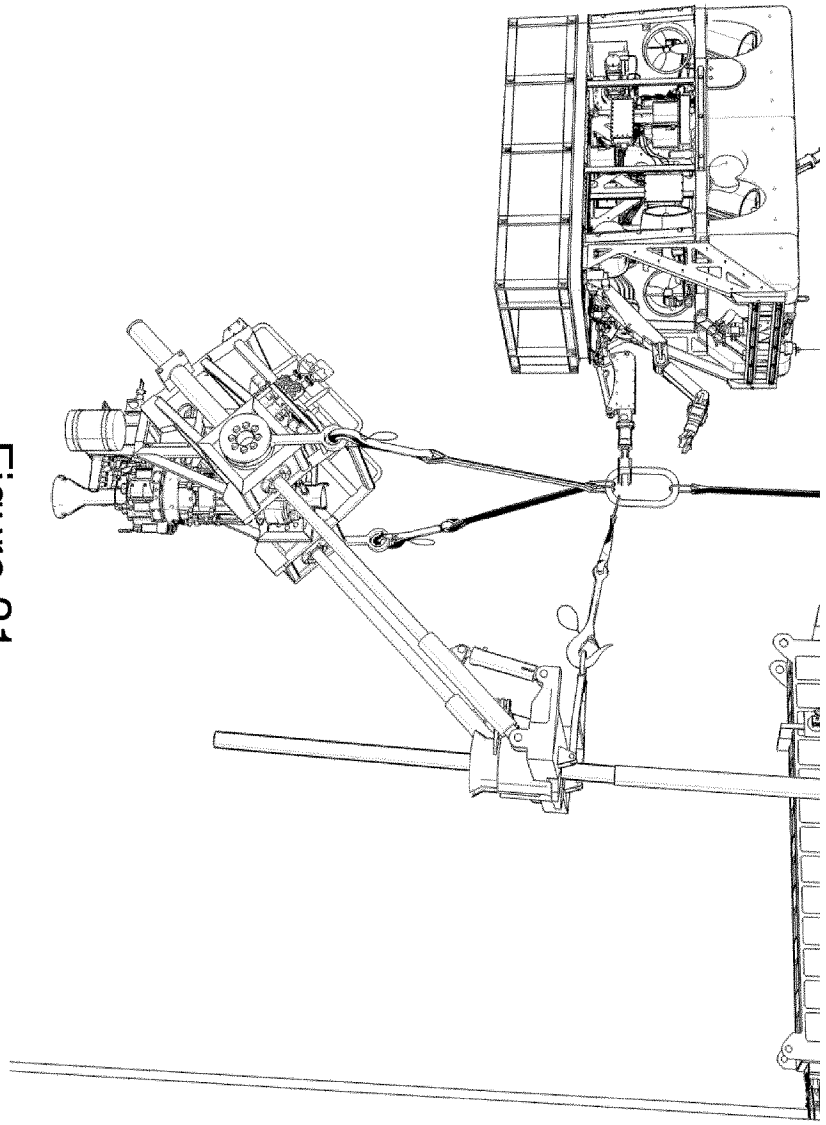
FIG. 31 shows a method step according to an aspect of the invention.
Figure 32:
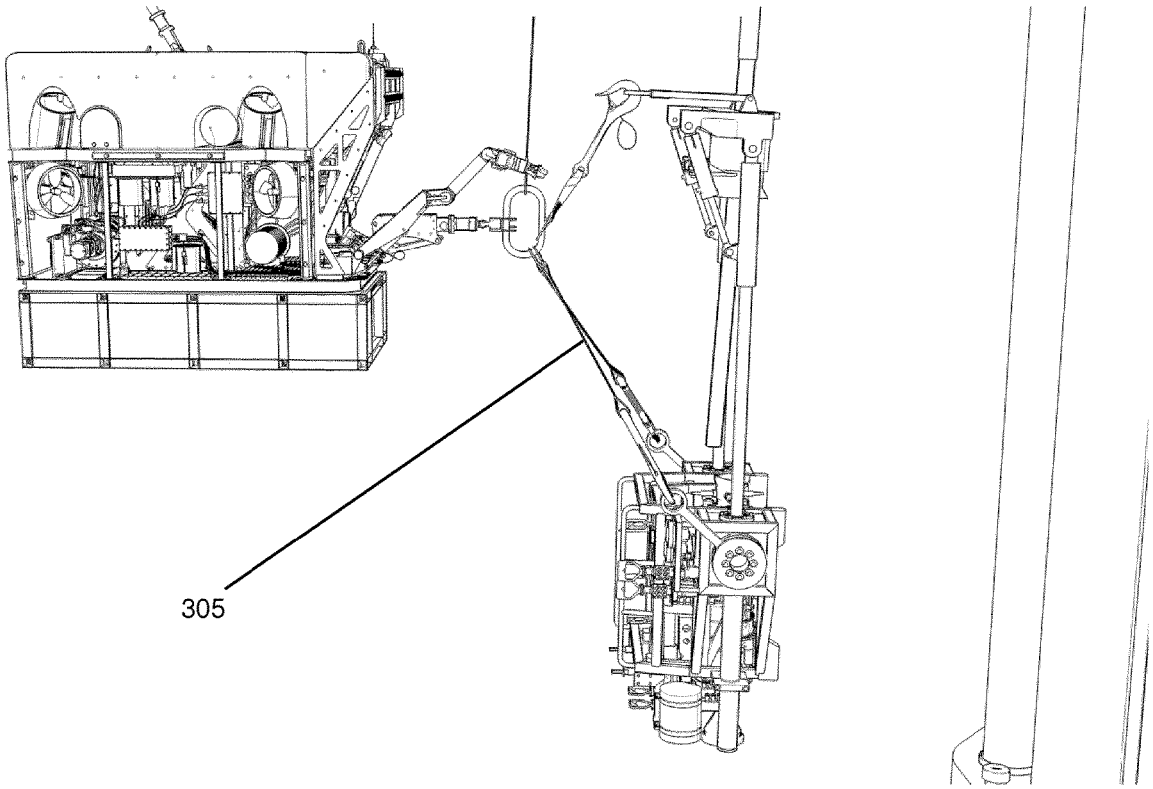
FIG. 32 shows a method step according to an aspect of the invention.

10) Move the AIA apparatus towards the riser pipe between the RJT and the GU apparatus, in one case keeping the load (including the AIA apparatus) under active heave compensation, FIG. 28. The AIA apparatus docking slot for the riser pipe has guide plates to facilitate guiding onto the riser pipe.

11) Guide the AIA apparatus docking slot onto the riser pipe with the ROV and lower the AIA apparatus until the lift rigging 305 is fully slack, FIGS. 29-32. Disconnect the lift rigging, FIG. 33. The docking slot can slide up and down the riser pipe including the three layer polypropylene coating. The amount the docking slot can slide is limited by the distance between the RJT and the GU apparatus. The docking cone is pre-adjusted so that its axis is roughly aligned with the riser pipe axis at the moment of docking. When being lowered, the hydraulic pitch cylinder on the AIA apparatus may bypass the hydraulic fluid to an accumulator tank to reduce the bending moment introduced into the riser pipe when the crane is lowering the AIA apparatus, flange adapter and flexible riser to a position where the loads become suspended from the riser pipe. The GU apparatus centralizes the docking cone as well as guiding it into the correct axial and rotational position. Some torsional forces may be introduced by the flexible riser, but these are assumed to be low. Maximum allowable landing speed will be determined by considering bending stresses induced in the riser pipe and radial reaction point loads in pipe wall. The self-activation property of the GU apparatus will create radial loads circumferentially on the riser pipe. Installing the AIA apparatus at an angle reduces risk of induced loads from the crane onto the prepared riser pipe end.

Figure 33:
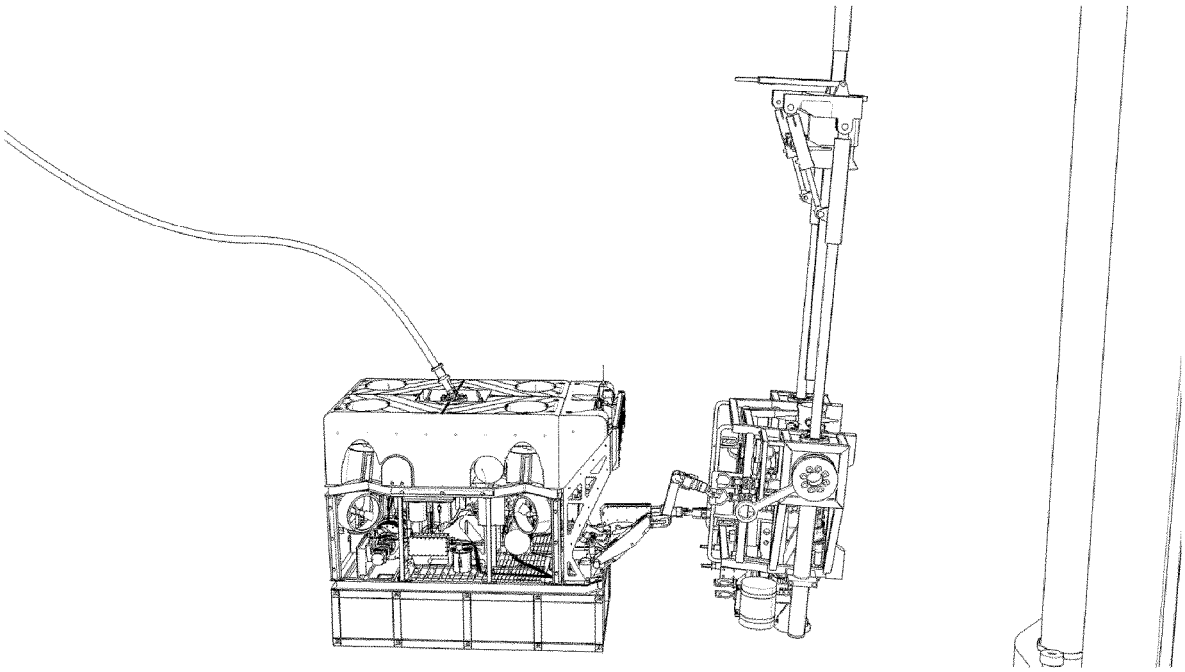
FIG. 33 shows a method step according to an aspect of the invention.

12) Grab onto the ROV panel of the AIA apparatus and close the 'float' function valve, FIG. 33. The float function is the bypass to the accumulator from the pitch cylinder, introduced to reduce bending moments in the riser pipe during landing, as well as reducing the bending moments on the extended pull-in cylinders. The ROV panel is designed with a grabber bar on the left side to provide a fixed position for the ROV. The grabber bar is used with the ROV's left 5-function 'grabber' arm, and the stab insert and valve operations are carried out with the right hand 7-function manipulator.

13) Insert 3 hydraulic 6-line stabs into receptacles on the ROV panel on the AIA apparatus. FMC/Oceaneering stabs may be used. All stabs may be delivered with D-handle as well as 'fishtail' handle for parallel 3-finger jaw.

14) Operate the pitch cylinder to lift the flange adaptor 306 until it is axially aligned with the riser pipe, FIG. 33. The pitch cylinder may be designed to provide up to 20 degrees of pitch. The pitch cylinder may be sized so that it cannot provide enough force to overstress the riser pipe.

15) Using, for example a level indicator, check that a plane through the axis of the two pull in cylinders is at 90 degrees to the riser bending plane. The ROV panel may have a level gauge to assist the visual indication that the AIA apparatus is correctly aligned.

16) If the angle is offset, operate the rotate cylinder to achieve axial alignment.

17) Stab the, for example Gisma, electrical/signal connector to the AIA apparatus. Tronic connectors may also be used.

Figure 34:
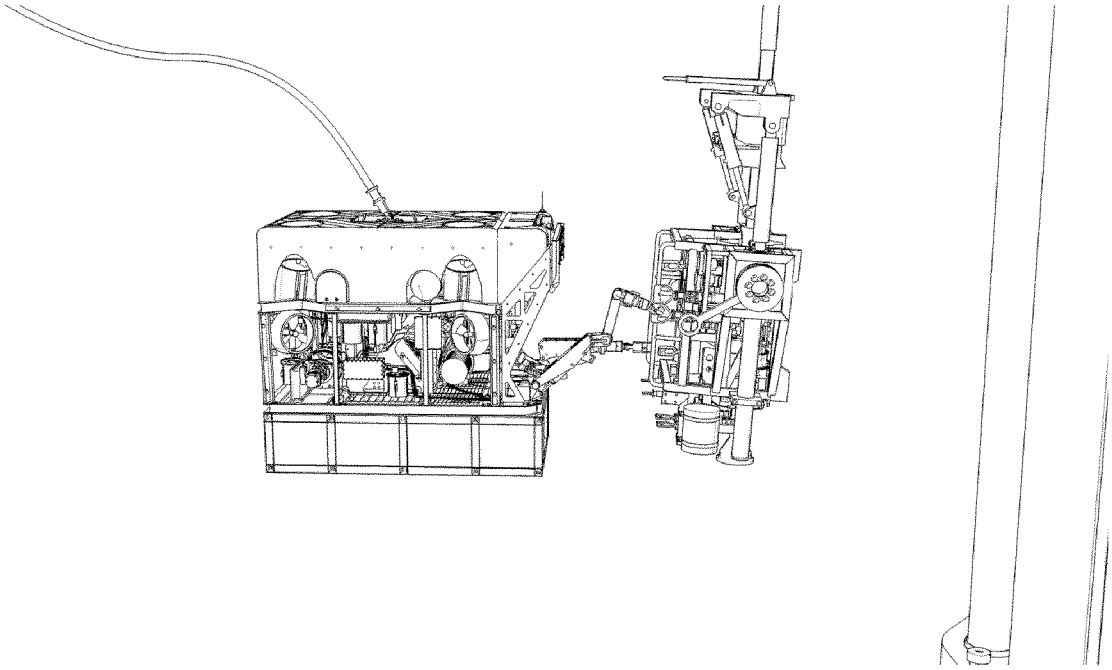
FIG. 34 shows a method step according to an aspect of the invention.

18) Increase the hydraulic pressure in the pull-in cylinders of the AIA apparatus until the AIA apparatus starts lifting, FIG. 34. Use visual feedback through dedicated camera and proximity sensors to confirm alignment. The AIA apparatus/flange adapter may have two cameras, 90 degrees offset with a sighting line along the connector axis. The cameras are used to provide visual verification of alignment to the operator. Furthermore, proximity sensors are installed on the flange adaptor to assist with alignment.

19) Check alignment just before entry of the riser pipe into the flange adaptor. Operate pitch, rotate, and pull-in cylinders to align.

20) Keep lifting the AIA frame using the pull-in cylinders until the riser pipe is fully bottomed out in the flange adaptor. Monitor sensor feedback can be used to monitor this part of the installation. The operator may operate the two pull-in cylinders independently from each other for fine alignment. The operator should continuously monitor the alignment by camera and pressure readings. The pressures should be kept low, only 2-5% above the necessary pressure to lift the suspended weight. If the pull-in stops, that is an indication of jamming and without increasing the pressure, the primary method to resolve it is to identify and lift only with the lowest (most extended) cylinder. The tilt and rotate function of the AIA apparatus can also be used for fine alignment at this stage. The two hydraulic circuits for the pull-in cylinders can also be operated in parallel after a certain engagement has been achieved, utilizing the flange adaptor's self-aligning capability. This may save a small amount of operation time. The cylinder interface to the AIA apparatus can be built with a small degree of flexibility, by rubber bushings or springs. This utilizes the self-alignment capability of the flange adaptor, and may reduce the number of jamming incidents and simplify the task for the operator.

21) Increase the holding pressure in the pull-in cylinders to hold the riser pipe firmly to the flange adapter abutment face. Upon activation of the flange adapter when the balls make initial contact with the surface of the riser pipe, the activation will tend to separate the end of the riser pipe from the abutment face. The pull-in cylinders are dimensioned to counteract that force.

22) Activate the flange adaptor. The 1500 bar pressure for the tensioners is achieved by integrating a hydraulic intensifier on the connector body. The sensors on the tool are linked up to the ROV skid, where the signal from each sensor is multiplexed onto an RS485 serial communication to the topside control unit. Visual indications provide backup for the sensors in the connector.

23) Perform a seal test. The seal test may be carried out with hydraulic oil. The volume to be tested is small and only a very small volume is required to increase the pressure to 350 bar. A very small volume would then be released to the sea upon completion of the seal test. A hydraulic intensifier may be used to provide the pressure for the seal test.

24) Disconnect the hydraulic stabs between the AIA apparatus and the flange adapter.

25) Cut or pull off the sensor cables between the AIA apparatus and the flange adaptor. For cutting, the ROV cable cutter may be used.

Figure 35:
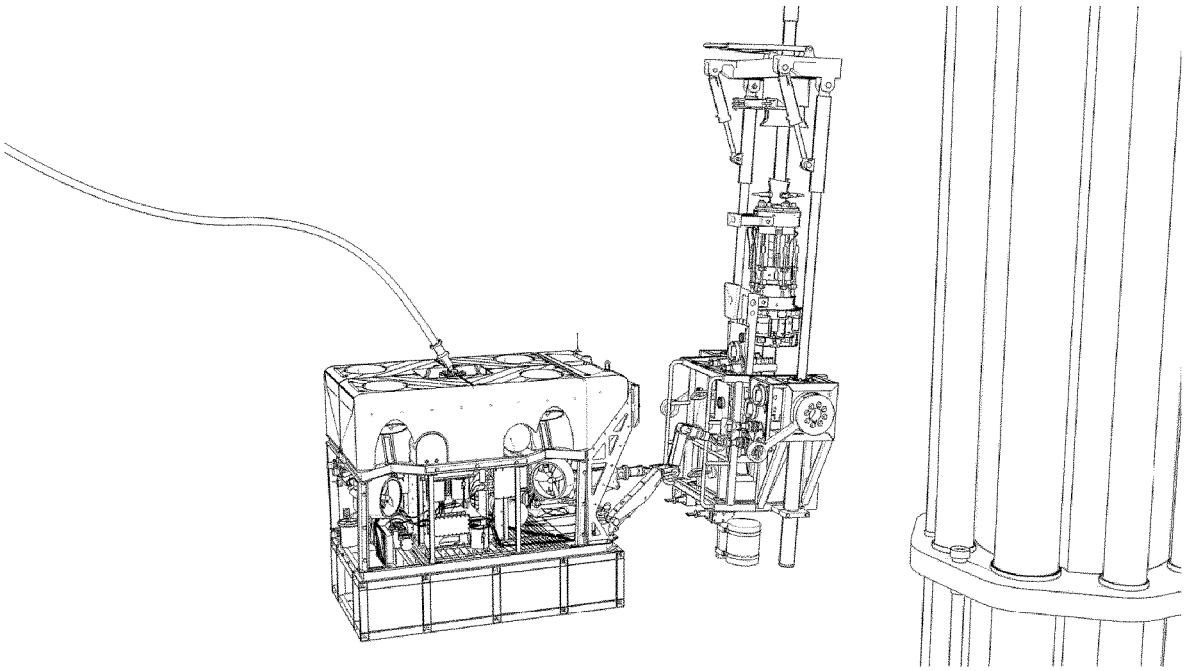
FIG. 35 shows a method step according to an aspect of the invention.

26) Unlock the locking-bolt with the ROV handle on the AIA apparatus, and extend the pull-in cylinders approximately 500 mm, FIG. 35. Ensure the AIA apparatus is fully undocked from the flange adaptor. Monitor separation between the docking cone and GU apparatus.

Figure 36:
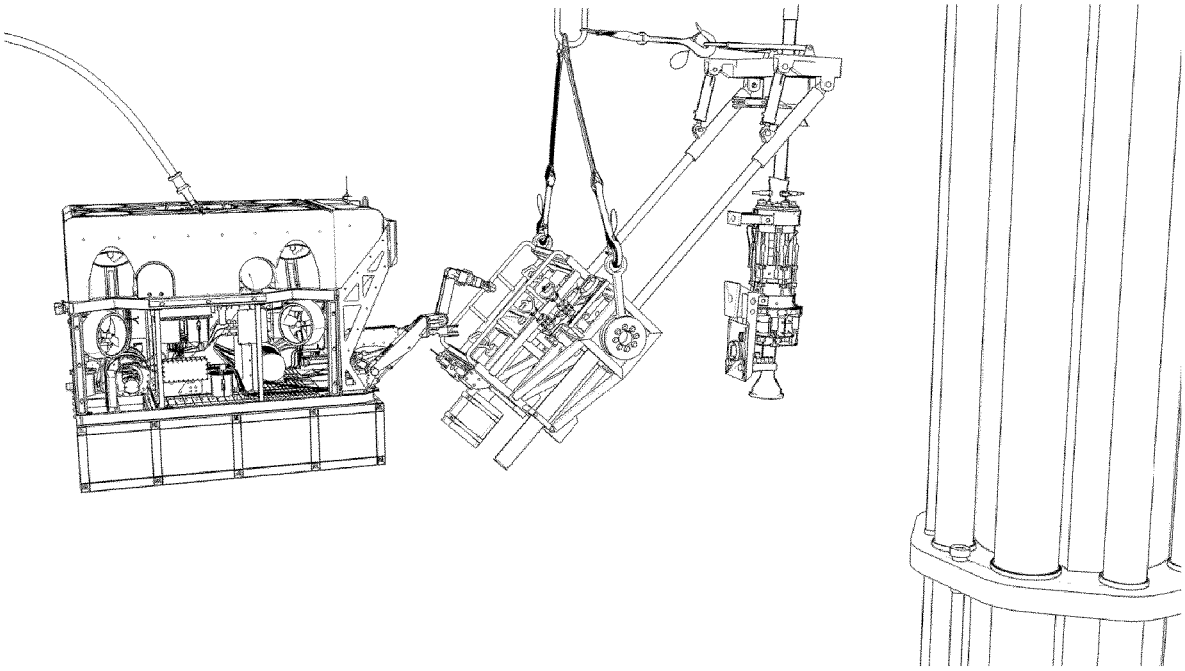
FIG. 36 shows a method step according to an aspect of the invention.

27) Using the pitch cylinders, start pitching the AIA apparatus out, away from the riser pipe, FIG. 36. When the flange adaptor and flexible riser have been disconnected from the AIA apparatus, the AIA apparatus can be tilted outwards by a larger angle without inducing a large amount of stress into the riser pipe. This creates sufficient clearance to recover the AIA apparatus without danger of impact with the flange adaptor.

28) If required, operate the rotate cylinder on the AIA frame back to neutral position to align the key-slots in the docking cone.

29) Operate the pitch cylinder until maximum distance between the AIA apparatus and the flange adaptor is achieved. Disconnect the ROV stabs. Note that an angle greater than 20 degrees can now be achieved as the weight of the flange adaptor and flexible riser has been removed from the AIA apparatus.

Figure 37:
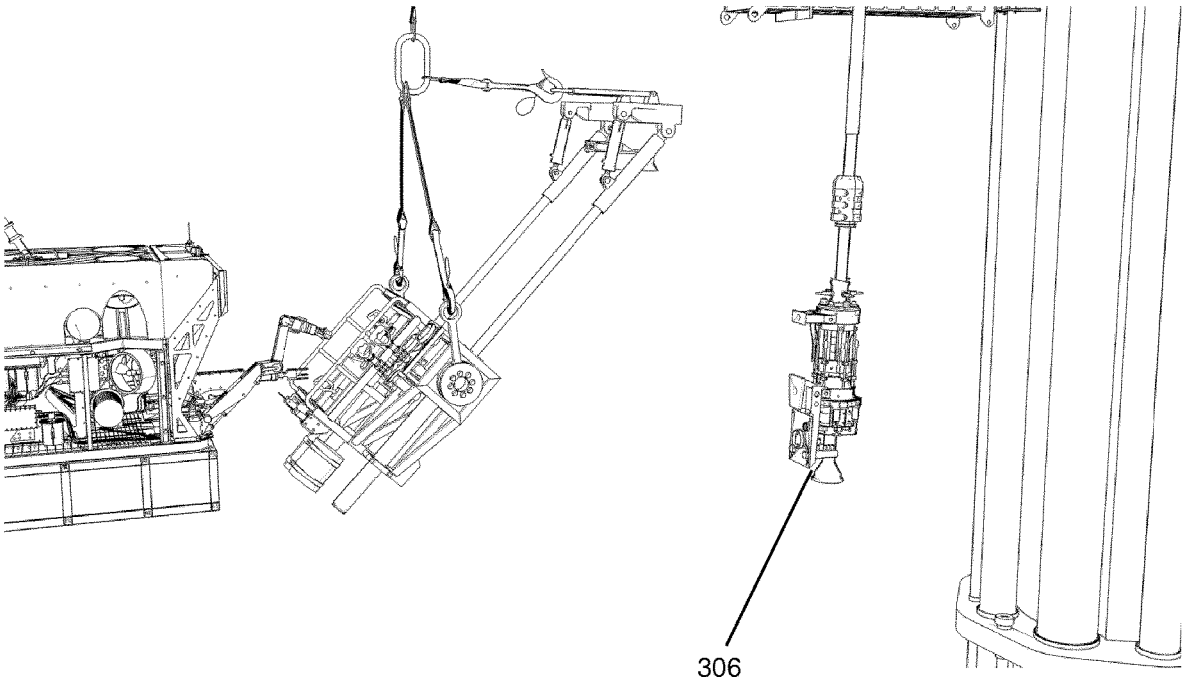
FIG. 37 shows a method step according to an aspect of the invention.
Figure 38:
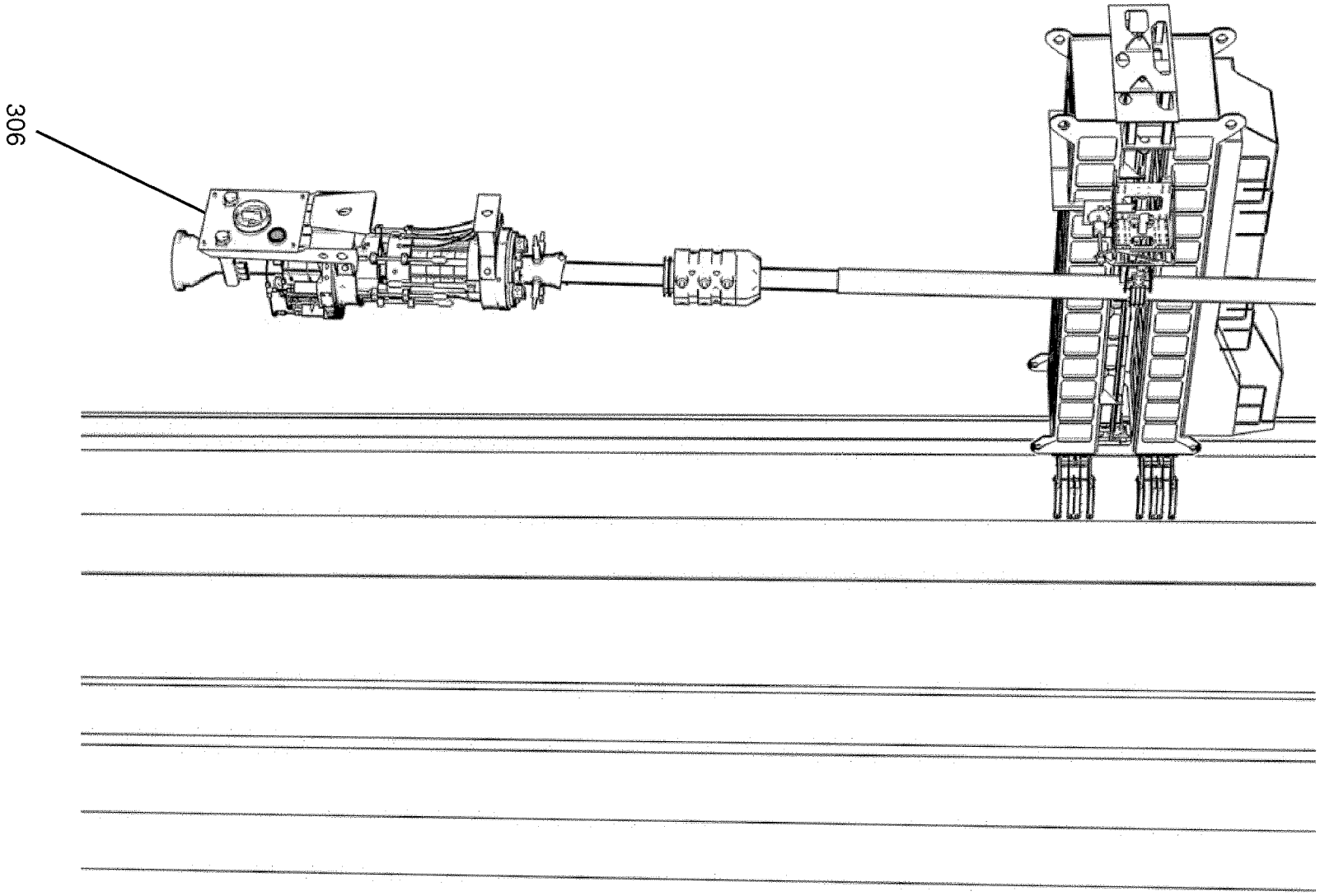
FIG. 38 shows a method step according to an aspect of the invention.

30) Lower the crane with a forerunner and hook onto a lift point of the AIA apparatus for recovery of the AIA apparatus back to the surface, FIG. 37. The center of gravity (COG) of the AIA apparatus will by this point have changed significantly, due to disconnection of the flange adaptor, hence a separate lift point may be used. The lift point is designed for ease of ROV hook connection 31) Lift the AIA apparatus clear of the GU apparatus.

32) By movement of the vessel and/or crane boom, move the AIA apparatus clear of the riser pipe by a safe distance. The AIA apparatus may also be guided with assistance from the ROV. What constitutes a safe distance may be dependent on weather and vessel station-keeping capability, as well as actual current.

33) Recover the AIA frame back to the vessel deck.

34) Deactivate and recover the GU apparatus to the tooling basket and subsequently recover to the vessel deck.

Figure 39:
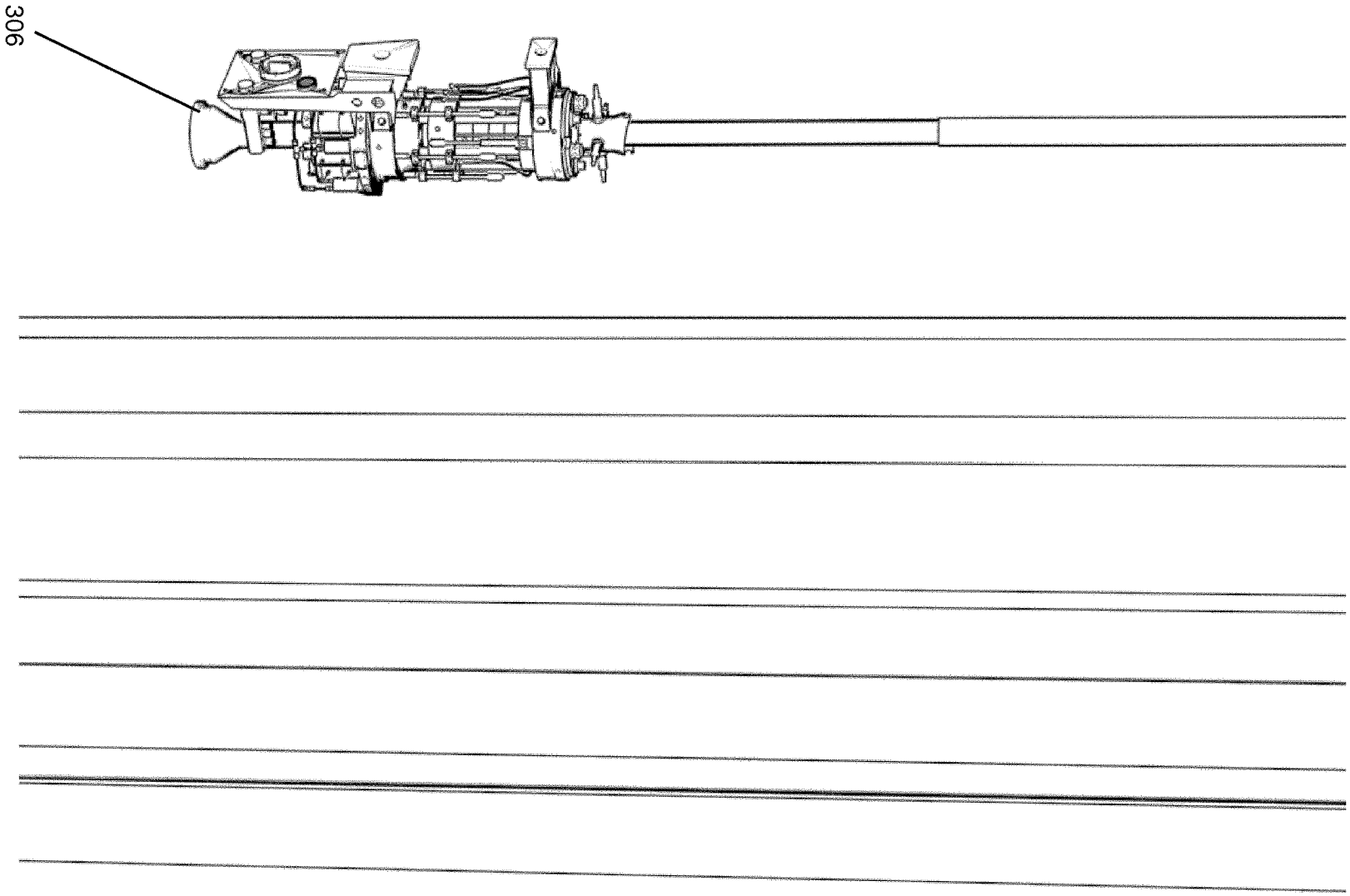
FIG. 39 shows a method step according to an aspect of the invention.

FIG. 39 shows the riser pipe with the installed flange adaptor 306 after completion of the method.

Although the invention has been described in terms of certain embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

What is claimed is:

1. A method of repairing a shaft, wherein the shaft is a subsea riser for use in the oil industry, the method comprising:

cutting through the shaft at a pre-determined location, resulting in a first shaft section and a second shaft section;

attaching a gripper unit apparatus onto the first shaft section;

landing an alignment and installation apparatus onto said gripper unit apparatus, the alignment and installation apparatus carrying a component to be installed on the cut end of the first shaft section, wherein the component is a connector for connecting the first shaft section to a flexible pipe;

pitching and rotating the alignment and installation apparatus to align an axis of the connector with the axis of the first shaft section;

contracting the alignment and installation apparatus, thereby translating the connector substantially along the axis of the first shaft section until the cut end of the first shaft section is positioned on or within the connector; and activating the connector to secure it onto the first shaft section, thereby enabling the communication of fluids between the flexible pipe and the first shaft section, wherein the gripper unit apparatus comprises teeth that are arranged to protrude slightly into the surface of a shaft and are arranged to attach the gripper unit apparatus to any position along part of a section of a shaft such that the gripper unit apparatus is not restricted to only attaching to an external flange or fixed connector on part of a section of a shaft.

2. The method according to claim 1, wherein said step of landing the alignment and installation apparatus comprises:

suspending the alignment and installation apparatus from a topside vessel, such that a portion of the apparatus designed to mate with the gripper unit apparatus is positioned substantially above the gripper unit apparatus;

maneuvering the alignment and installation apparatus substantially along the axial direction of the first shaft section until said portion of the alignment and installation apparatus comes into contact with the gripper unit apparatus; and releasing the alignment and installation apparatus from the topside vessel such that the alignment and installation apparatus becomes supported on the first shaft section by the gripper unit apparatus.

3. The method according to claim 2, further comprising using a remotely operated vehicle to guide the alignment and installation apparatus whilst it is suspended from the topside vessel.

4. The method according to claim 2, wherein the alignment and installation apparatus is configured such that it transmits substantially only axial loads to the first shaft section via the gripper unit apparatus when it is released from the topside vessel onto the gripper unit apparatus.

5. The method according to claim 1, wherein the gripper unit apparatus comprises:

a body comprising two half-shells having internal surfaces of semi-circular cross section;

a plurality of segments arranged inside the two half-shells and comprising teeth for gripping onto the riser; and a cap provided on the body and shaped so as to interface with a docking device;

wherein an installation tool operable by a ROV is arranged to cause the two half-shells to close around the riser, thereby securing the gripper unit apparatus to the riser; and wherein the alignment and installation apparatus comprises:

a frame;

an interface element for supporting said component, the interface element being removably attached to the frame;

the docking device, wherein the docking device is configured to mate with the gripper unit apparatus provided on the riser, the docking device being movably attached to the frame; and one or more actuators for controlling the position of the frame relative to the riser when in use.

* * * * *